US007672608B2

(12) United States Patent
Taki et al.

(10) Patent No.: US 7,672,608 B2
(45) Date of Patent: Mar. 2, 2010

(54) IMAGE FORMING APPARATUS

(75) Inventors: Kenji Taki, Fuchu (JP); Chikatsu Suzuki, Hachioji (JP); Fusako Akimoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 423 days.

(21) Appl. No.: 11/812,898

(22) Filed: Jun. 22, 2007

(65) Prior Publication Data

US 2008/0003000 A1 Jan. 3, 2008

(30) Foreign Application Priority Data

Jul. 3, 2006 (JP) ..... 2006-183789
May 9, 2007 (JP) ..... 2007-124415

(51) Int. Cl.
*G03G 21/20* (2006.01)

(52) U.S. Cl. ..... 399/97

(58) Field of Classification Search ..... 399/91, 399/94, 97, 381, 388, 391, 393; 271/97, 271/98

See application file for complete search history.

(56) References Cited

U.S. PATENT DOCUMENTS 4,727,385 A * 2/1988 Nishikawa et al. ..... 347/152
5,600,427 A * 2/1997 Watanabe et al. ..... 399/97
7,575,231 B2 * 8/2009 Sasaki et al. ..... 271/98
2008/0247774 A1 * 10/2008 Koga ..... 399/97

FOREIGN PATENT DOCUMENTS

JP 2000-255807 * 9/2000
JP 2003-276883 10/2003

* cited by examiner

*Primary Examiner*—Hoan H Tran
(74) *Attorney, Agent, or Firm*—Finnegan, Henderson, Farabow, Garrett & Dunner, L.L.P.

(57) ABSTRACT

An image forming apparatus, including an image forming section which conducts image formation on a sheet based on an image data, a tray which accommodates the sheets to be supplied to the image forming section, a humidity detecting unit which detects humidity inside the tray, a dehumidifying device which conducts dehumidification inside the tray; and a control section which controls the image forming section to prohibit image formation when the humidity inside the tray is higher than a predetermined value, the control section further controls the dehumidifying device to conduct the dehumidification inside the tray when the humidity inside the tray is equal to or lower than the predetermined value, and the control section still further controls the image forming section to conduct the image formation on the when the humidity inside the tray has been equal to or lower than the predetermined value.

18 Claims, 19 Drawing Sheets

IMAGE FORMING APPARATUS

This application is based on Japanese Patent Application Nos. JP2006-183789 filed on Jul. 3, 2006, and JP2007-124415 filed on May 9, 2007, with the Japanese Patent Office, the entire content of both are hereby incorporated by reference.

TECHNICAL FIELD

The present invention relates to an image forming apparatus, such as a copy machine, a printer, and a compound machine, and in particular, to an image forming apparatus in which humidity can be controlled.

BACKGROUND OF THE INVENTION

In an image forming apparatus, such as a copy machine, a printer, and a compound machine, based on image data which is read by a document reading device, a toner image is formed on an image carrier provided in the image forming apparatus, and after the toner image is transferred onto a recording sheet supplied from a tray, the toner image is fixed, whereby permanent image formation (or printing) is performed.

Since various types of sheets are used for printing, a coated sheet is characterized in that its air permeability is relatively low due to its coated surface, further, under a high humidity environment, moisture tends to be trapped between adjacent stacked coated sheets. Accordingly, adhesion force tends to be high between the stacked sheets, and a top coated sheet is not easily separated from a second stacked coated sheet on the tray, whereby the coated sheets are not easily supplied to the apparatus, resulting in erratic sheet feeding. Still further, when the recording sheet is conveyed under said high humidity, and printing is conducted on the sheet, paper sheet debris generated from the recording sheets accumulates in the conveyance path, interfering with proper operation of optical sensors mounted in the conveyance path to detect the recording sheets. To overcome these problems, an image forming apparatus is proposed in which a dehumidifying heater is mounted within each tray to decrease the humidity of the coated sheets. Further, in an image forming apparatus disclosed in Japanese Unexamined Patent Application Publication No. 2003-276,883, the humidity in the apparatus is detected by a humidity sensor, and if the humidity is relatively high in the apparatus, a tray featuring a long conveyance path is automatically selected, and sheet debris is controlled to not be generated in the high humidity environment, so that the optical sensors, mounted in the conveyance path which is commonly used with other trays, are prevented from being covered with said debris.

However, such dehumidification is not sufficient in some cases. For example, just after power is switched on, or during environmental variation, if coated sheets are being conveyed in the path, they tend to cause a jam, or sheet debris may accumulate on the conveyance path, which are major problems. Further, if printing is conducted on the recording sheet under high humidity, heat is absorbed by moisture in the recording sheet, and fixing temperature in the recording sheet does not reach a desired temperature, which may cause an insufficiently fixed image due to low fixing temperature.

Still further, in the image forming apparatus proposed in the above patent document, sheet debris tends to accumulate on the optical sensor mounted near the tray which supplied the sheets, tending to cause the coated sheets to jam, due to the high humidity environment.

SUMMARY OF THE INVENTION

The present invention has been achieved to overcome the above problems, and an object of the present invention is to provide an image forming apparatus which effectively prevents paper jams, accumulation of sheet debris on the conveyance path, and insufficiently fixed images due to fixing failure, while supplying sufficiently dehumidified recording sheets for printing.

The above object can be attained by the structures described below.

An image forming apparatus which includes:

an image forming section which conducts image formation on a recording sheet based on image data, a tray which accommodates the sheets to be supplied to the image forming section, a humidity detecting unit which detects humidity inside the tray, a dehumidifying device which conducts dehumidification inside the tray, and a control section;

wherein when the humidity inside the tray is higher than a predetermined value, controls the image forming section to prohibit the image formation, further when the humidity inside the tray is equal to or lower than the predetermined value, the control section controls the dehumidifying device to conduct the dehumidification inside the tray, still further when the humidity inside the tray reaches lower than the predetermined value, the control section controls the image forming section to conduct the image formation.

Based on the present invention described above, since image formation is prohibited on sheets of high humidity, the problems are overcome, such as the generation of paper jams, accumulation of sheet debris, and the decrease of the fixing temperature.

DETAILED DESCRIPTION OF THE PREFERRED EMBODIMENT

An embodiment of the present invention will now be detailed, while referring to FIGS. 1-20.

Figure 1:
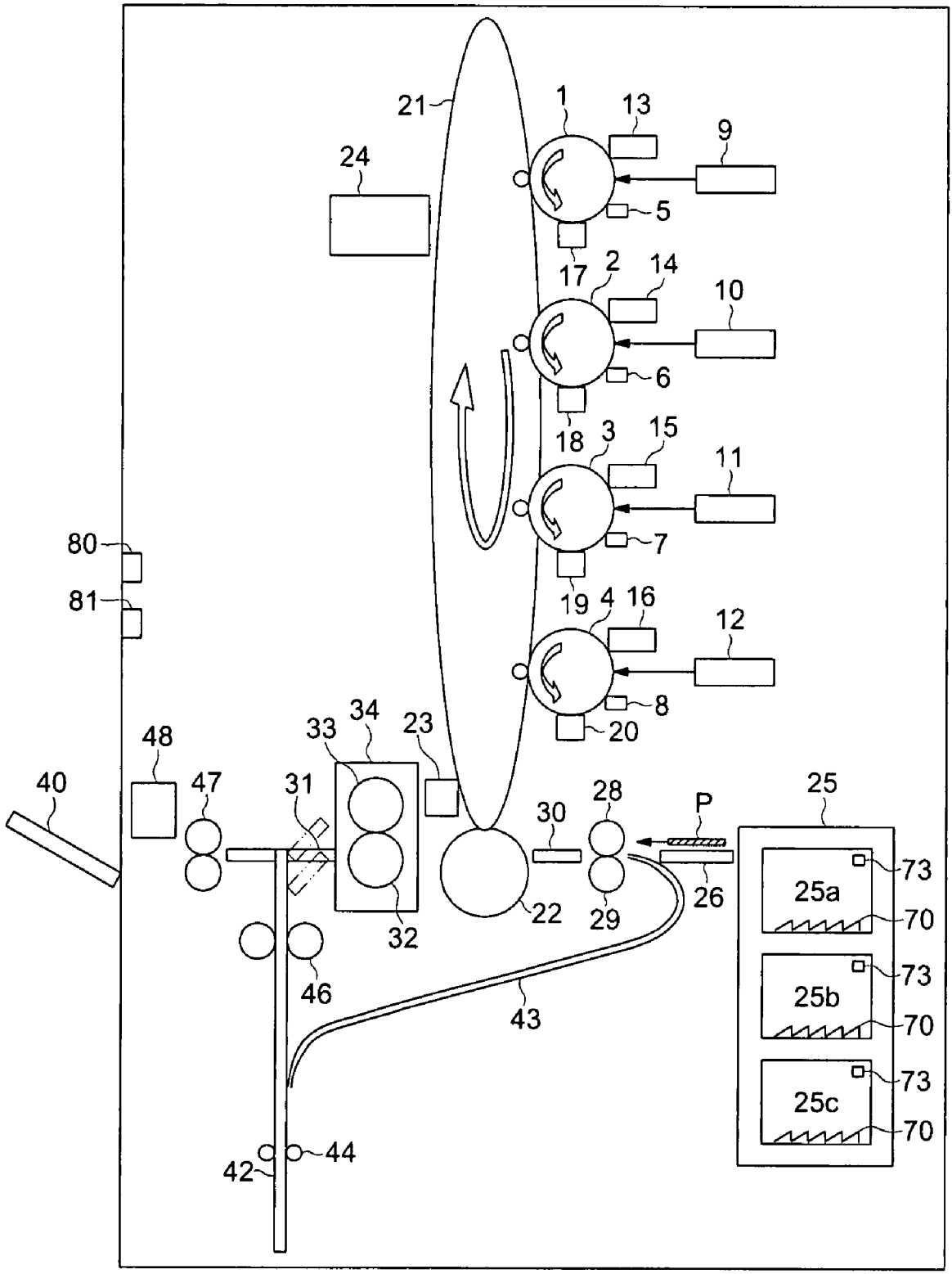
FIG. 1 is a schematic view showing the mechanical structure of an image forming apparatus of the present invention.

FIG. 1 is a schematic view showing a mechanical structure of the interior of the image forming apparatus, of the present invention.

The image forming apparatus incorporates charging devices 5-8 provided for four colors (which are Y, M, C and K), exposure sections 9-12 which form latent images of four colors, and dual component developing devices 13-16 provided for four colors, around photo conductors 1-4 provided for four colors, which rotate in arrowed directions. Further the image forming apparatus incorporates intermediate transfer body 21 which sequentially transfers the latent images, formed on image carriers 1-4, and transfer roller 22 which transfers the images formed on intermediate transfer body 21 onto a recording sheet which will be detailed later. Still further, in adjacent to intermediate transfer body 21, separation section 23 and cleaning device 24 are mounted, both of which exist on the downstream of transfer roller 22 with respect to the rotation direction of intermediate transfer body 21. Control section 4 having CPU, ROM and RAM, controls output timings, output values and output polarities of these loads.

Figure 3:
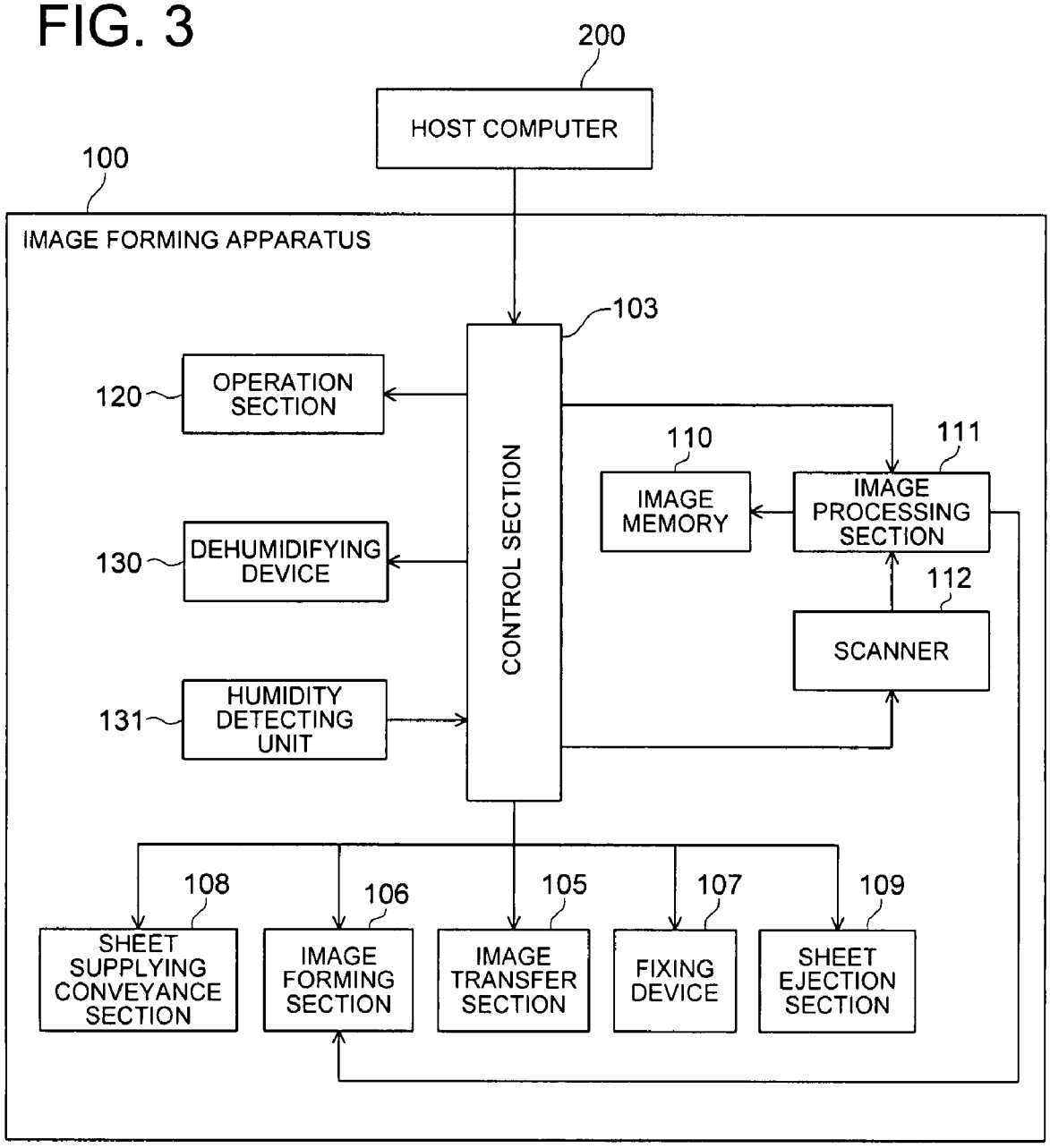
FIG. 3 is a block diagram showing a functional structure of the image forming apparatus of the present invention.

Still further, image forming section 106, shown in FIG. 3, is formed of above-described photo conductors 1-4, charging devices 5-8, exposure sections 9-12, and developing devices 13-16. Further, transfer section 105, also shown in FIG. 3, is formed of transfer rollers 21 and 22.

Still further, in the image forming apparatus, sheet supply section 25 is provided, which includes plural trays 25*a*-25*c* to accommodate the sheets. Three trays are illustrated in FIG. 3, but the present invention does not limit the number of trays, that is, a single tray can be used, or a tray which can accommodate a large number of sheets can be used.

Figure 2:
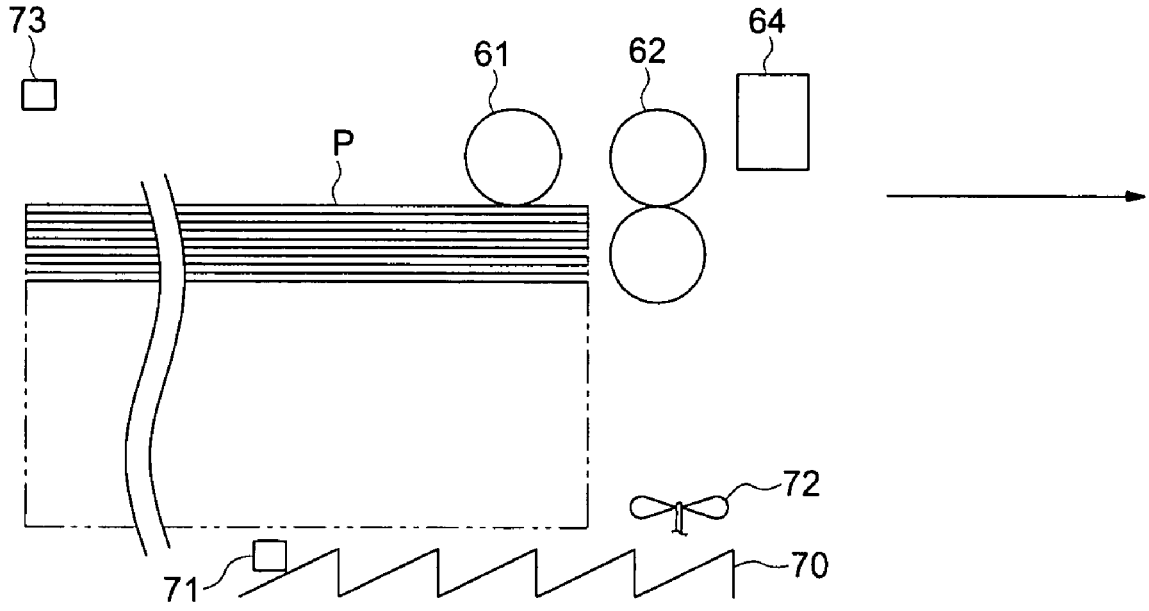
FIG. 2 is a schematic view showing the interior of a portion of a tray of the present invention.

In FIG. 2, the sheets to be supplied are accommodated in each of trays 25*a*-25*c*. Above each roller, separating roller 61 is mounted, which is vertically driven by a solenoid, but which is not illustrated. Paired feed-out rollers 62 are mounted to receive sheet P separated by separating roller 61, and optical sensor 64 is mounted at the downstream of paired feed-out rollers 62, which detects the top of sheet P. Further, in trays 25*a*-25*c*, dehumidifying heater 70 is mounted, which serves as the dehumidifying device to dehumidify the inside of the tray. In order to judge the humidity by the indirect detection of the humidity inside the tray, temperature sensor 73 is mounted, which detects the temperature in the tray. Still further, the image forming apparatus incorporates external humidity sensor 80 which detects the humidity outside the apparatus, and external temperature sensor 81 which detects the temperature outside the apparatus, both of which are illustrated in FIG. 1. A humidity detecting unit to detect the humidity inside the tray is structured of temperature sensor 73 to detect the temperature in the tray, external humidity sensor 80, external temperature sensor 81, and a detecting program stored in the control section.

In FIG. 1, sheet P supplied from one of trays 25*a*-25*c* is conveyed through a conveyance path having guide plate 26. Registration rollers 28 and 29, which adjust the position of sheet P, are mounted on the conveyance path. Transfer section 105, which includes guide plate 30 and transfer roller 22, is positioned at the downstream of registration rollers 28 and 29.

Sheet supplying conveyance section 108 in FIG. 3 is structured of the conveyance path which includes trays 25*a*-25*c*, separation roller 61, paired feed-out rollers 62, guide plates 26 and 30, and registration rollers 28 and 29.

Fixing device 34, which includes pressure roller 32 and heat roller 33, is mounted at the downstream of transfer section 105. Gate 31, which switches a conveyance path, is mounted at the downstream of fixing device 34. Sheet reversing path 42 is provided as the conveyance path to be switched by gate 31. Paired reversing ejection rollers 46 and paired reversing rollers 44 which is downstream of paired reversing ejection rollers 46 are mounted on sheet reversing path 42. Double sided sheet path 43 is mounted in the feed-out direction of paired reversing rollers 44. The top of double sided sheet path 43 positions at an entrance side of registration rollers 28 and 29. Gate 31, sheet reversing path 42, paired reversing rollers 44 and double sided sheet path 43 structure a portion of sheet supplying conveyance section 108.

Paired sheet ejection rollers 47 is mounted straight downstream of gate 31, and further downstream, sheet ejection sensor 48 and sheet ejection tray 40 are mounted. Sheet ejection section 109 shown in FIG. 3 is structured of gate 31, paired sheet ejection rollers 47, sheet ejection sensor 48 and sheet ejection tray 40.

Next, operation of the above-described mechanical structure is detailed.

In the image forming operation, photo conductors 1-4 are driven by motors which are not illustrated, and the surfaces of photo conductors 1-4 are electrically charged by charging devices 5-8 which are activated by a power source which is not illustrated, after which the image data is written on the surfaces by laser beams emitted from exposure sections 9-12, whereby electrostatic latent images are formed on the surfaces of photo conductors 1-4. The formed electrostatic latent images are reversely developed by developing biases generated by developing devices 13-16, whereby the images become visible as toner images on the surfaces of photo conductors 1-4. After which the toner images are transferred onto intermediate transfer body 21, which is primary transfer. Remaining toner on photo conductors 1-4 after the primary transfer is removed by cleaning sections 17-20.

On the other hand, sheet P is fed out from trays 25*a*-25*c* one by one, and is guided by guide plate 26 to registration rollers 28 and 29. In trays 25*a*-25*c*, separating roller 61 rotates on stacked sheets P to separate only top sheet P from stacked sheets P, and separated top sheet P is conveyed toward paired rollers 62. However, when the coated sheets are used as sheets P, the coated surface of the coated sheet has low air permeability. When environment is high humidity, moisture is maintained between the coated sheets, due to this, contacting force between the coated sheets increases, and the top sheet of the stacked coated sheets cannot be separated from the second sheet on the tray, whereby the sheet cannot be supplied, resulting sheet jam. Therefore, in order to reduce the humidity, dehumidifying heater 70, temperature sensor 71 for dehumidifying heater 70, dehumidifying fan 72 and temperature sensor 73 for the inside of tray are mounted on the tray.

Dehumidifying heater 70 is, for example, continuously controlled to 70° C., while temperature sensor 71 measures temperature at a position adjacent to heater 70. In the image forming apparatus of the present invention, the temperature inside the tray is controlled to be higher than the temperature outside the apparatus so that the dehumidify is conducted. In order to maintain the temperature inside the tray at the predetermined temperature, control section 103 checks the output value of temperature sensor 73 inside the tray, and activates dehumidifying fan 72 until the temperature inside the tray reaches predetermined value, and thereby heated air generated by dehumidifying heater 70 is sent inside the tray, and when the temperature inside the tray reaches the predetermined temperature, dehumidifying fan 72 is stopped.

Sheet P, supplied from any one of trays 25*a*-24*c*, is corrected by registration rollers 28 and 29 with respect to irregularity of the top of sheet P, after which sheet P is synchronously conveyed to transfer roller 22 at timing when the toner image on intermediate transfer body 21 just exactly meets an image position. Sheet P, conveyed by registration rollers 28 and 29 is guided by guide plate 30, and is conveyed to a transfer nipping section structured of intermediate transfer body 21 and transfer roller 22. Bias voltage of inverse polarity to the toner is applied to transfer roller 22, and due to the forth of static electricity, the toner image on intermediate transfer body 21 is secondarily transferred onto sheet P. Sheet P, carrying the toner image, is electrically neutralized ted by eliminating section 23, and is separated from intermediate transfer body 21, after which sheet P is conveyed to fixing device 34 incorporating heat roller 33 and pressure roller 32. In a case of single-sided printing, sheet P, carrying the image heat-fixed by fixing device 34, is ejected onto external sheet ejection tray 40 through gate 31 and paired sheet ejection rollers 47.

In a case of double-sided printing, sheet P is switched by gate 31 to be conveyed to sheet reversing path 42, whereby sheet P is reversed by paired reversing rollers 44, and is re-conveyed to registration rollers 28 and 29 through double sided sheet path 43, after sheet P is corrected by registration rollers 28 and 29 with respect to irregularity of the top of sheet P, sheet P is ejected onto external sheet ejection tray 40, in the same manner as in single-sided printing. Further, after the surface of intermediate transfer body 21 passes through the nipping section, the surface is cleaned by cleaning section 24 so that any remaining toner on the surface is removed, and image formation is repeated in the same way as described above.

Next, the functional structure of the image forming apparatus of the present invention is detailed while referring to the block diagram of FIG. 3. Image forming apparatus 100 includes a printing function and a copying function. When the printing function is active, after control section 103 receives printing instructions from host computer 200, control section 103 sends image processing instructions to image processing section 111, and simultaneously sends print starting instructions to image forming section 106. Control section 103 is formed of a CPU, ROM storing the control programs, and a nonvolatile memory section, such as a flash memory, which is not illustrated, to store various setting information.

After receiving the image processing instructions, image processing section 111 conducts an imaging process on the image data sent from host computer 200, then image memory 110, structured of RAM or HDD, stores the processed data. Image processing section 111 is structured of CPU and ROM having the control programs.

On the other hand, when the copying function is active, the user presses a copy button on operation section 120, then the printing instruction is sent to control section 103, and control section 103 outputs image processing instructions to image processing section 111, scan start instructions to scanner 112, and print start instructions to image forming section 106, respectively. Upon receiving the scan start instructions, scanner 112 controls a CCD image scanner and a document exposure lamp to enable scanning of the document. Further, upon receipt of the image processing instructions, image processing section 111 memorizes the image data, produced by scanner 112, in image memory 110.

Still further, whichever function, is active being either the printing function and the copying function, upon receipt of the print start instructions, image forming section 106 receives the image data from image memory 110 through image processing section 111, and starts to conduct image formation to produce toner image, after which it instructs sheet supplying conveyance section 108 to feed sheet P toward registration rollers 28 and 29, where sheet P is temporarily stopped, after which sheet P is again conveyed so as to exactly meet the toner image arriving at transfer roller 22, the toner image is then transferred onto sheet P by transfer section 105. After fixing device 107 permanently fixes the toner image onto sheet P by heating and pressing between the nip of heat roller 33 and pressure roller 32, sheet P is ejected outside the apparatus by sheet ejection section 109, which has paired sheet ejection rollers 47 and sheet ejection sensor 48.

Humidity detecting unit 131 is structured of temperature sensor 73, which is mounted in each tray of sheet supplying conveyance section 108 and detects the temperature inside the respective tray, external humidity sensor 80, which is mounted outside the apparatus, and external temperature sensor 81 which is mounted outside the apparatus. The results detected by these sensors are sent to control section 103. Dehumidifying device 130 is structured of dehumidifying heater 70, temperature sensor 71 used for dehumidifying heater 70, and dehumidifying fan 72, which is controlled by control section 103. Control section 103 controls dehumidifying device 130 to dehumidify the inside of the tray, based on the humidity data detected by respective humidity detecting unit 131, accordingly dehumidifying device 130 is mounted in each tray of sheet supplying conveyance section 108. For the dehumidifying operation, a targeted humidity is established as a predetermined value, but in the present embodiment, the temperature inside the tray is practically the target parameter of the control, not the humidity inside the tray. That is, based on the detected external humidity and the external temperature, the temperature inside the tray is controlled to be the targeted temperature, whereby dehumidification of the inside of the tray is performed. When the temperature inside the tray is higher than the targeted temperature, control section 103 determines that the humidity is to be maintained to be equal to or lower than the predetermined value. Further, after the external humidity is related to the external temperature, the targeted temperature to be converted to the predetermined value concerning the humidity is stored in the non-volatile memory section, such as flash memory, in control section 103. That is, the targeted temperature inside the tray is determined as described below. Control section 103 controls dehumidifying heater at 70° C., and activates or deactivates dehumidifying fan 72 so that air heated by dehumidifying heater 70 is sent inside the tray or is not sent, whereby the temperature inside the tray is maintained to be equal to or lower than the targeted temperature.

Additionally, the humidity detecting unit can be formed of an indirect method as described above, or formed of a direct method in which a humidity sensor is installed inside each tray.

When external humidity is lower than 56%, dehumidifying heater 70 and dehumidifying fan 72 are not activated.

When external humidity is between 56%-60%, the targeted temperature is equal to (external temperature+6° C.), When external humidity is between 61%-65%, the targeted temperature is equal to (external temperature+7° C.), When external humidity is between 66%-70%, the targeted temperature is equal to (external temperature+8° C.), When external humidity is between 71%-75%, the targeted temperature is equal to (external temperature+9° C.), and When external humidity is higher than 75%, the targeted temperature is equal to (external temperature+10° C.), wherein when the external humidity is equal to or higher than 56%, dehumidifying heater 70 is activated to be 70° C.±10° C.

Further, when control section 103 controls dehumidifying device 130, control section 103 calculates the estimated time interval when the temperature of any predetermined tray reaches the predetermined value. In the present embodiment, the estimated time interval when the temperature inside the tray reaches the targeted temperature is determined by a simple expression shown below.

estimated time interval (minute)=[targeted temperature(° C.)−temperature inside the tray (° C.)]/(° C./minute)

Further, a predetermined time interval, serving as a base to change control, has been set in control section 103, when control section 103 is activated based on the above estimated time. For example, a time interval of 5 minutes can be set as an initial value, and said set value can be stored in the non-volatile memory section, such as the flash memory in control section 103. Additionally, the predetermined value can be changed by operation section 120, and said changed predetermined value can also be stored in memory section 103.

Humidity control of the tray is conducted at an appropriate time by control section 103, for example, when the image forming apparatus is activated, or when the execution of printing job is instructed. Further, when coated sheets which require humidity control are used, the humidity control of the tray is conducted.

Control section 103 receives the humidity conditions inside each tray, and determines whether or not the humidity inside each tray is equal to or lower than the predetermined value. When the humidity of any one of the trays is equal to or lower than the predetermined value, control section 103 executes image formation, while when it is greater than the predetermined value, control section 103 inhibits image formation.

Figure 4:
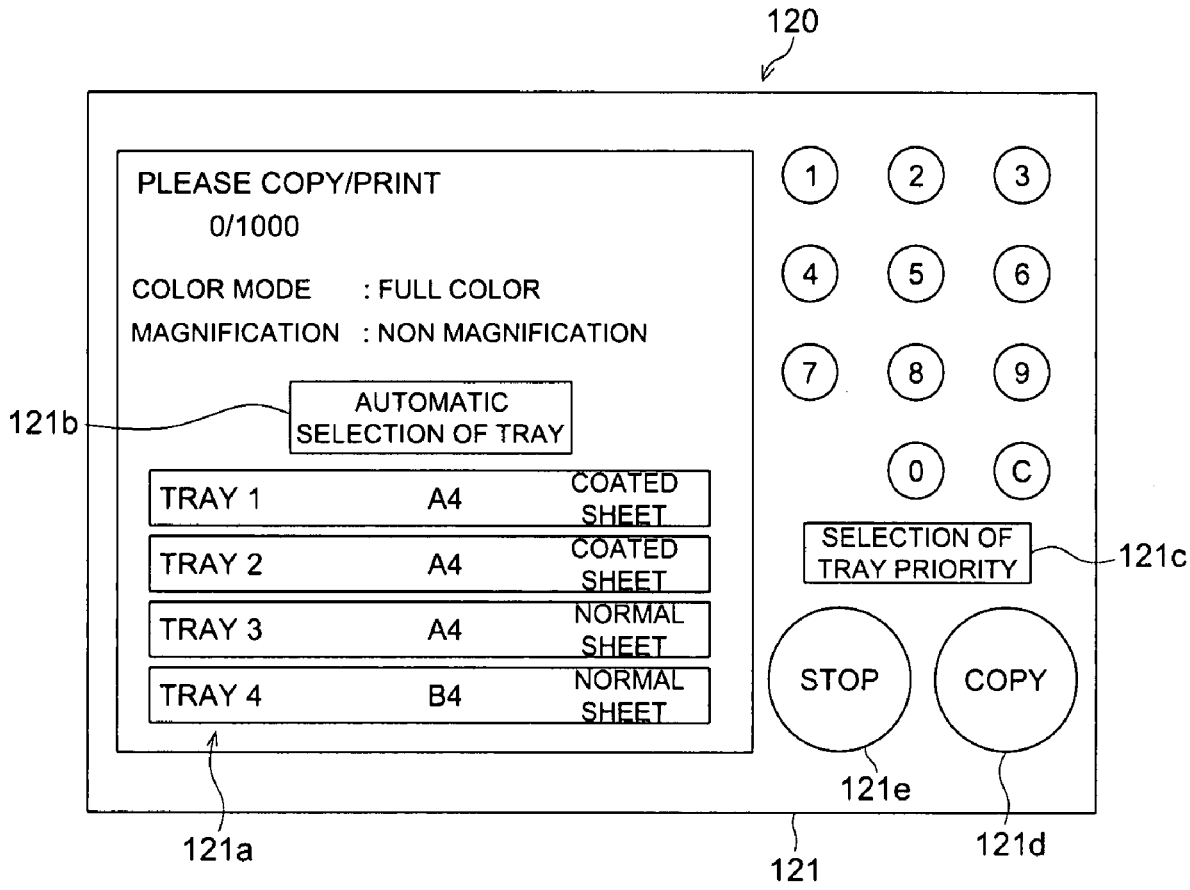
FIG. 4 shows an operational section of the present invention, on which a normal operation screen is displayed.

Image forming apparatus 100 incorporates operation section 120, which is structured of a touch panel, for example, and which displays various information and by which the operator inputs various settings. Operation section 120 is controlled by control section 103. Inputted information through operation section 120 is sent to control section 103. FIGS. 4-7 show the structures of operation section 120, which is mounted at an appropriate position on image forming apparatus 100 to be operated by the operator. In the present embodiment, operation section 120 is structured of a touch display and plural buttons. FIG. 4 shows the user operation screen 121 in a normal condition as a copy/print mode. In this screen, four trays are prepared on stages, and on tray display section 121*a*, the size and type of the sheets accommodated in the tray on each stage are shown. When the user touches "automatic tray selection" button 121*b* by each touch, an automatic tray selection function is changed between an effective condition and a no-effective condition. The automatic tray selection function means a function in which a tray to be used for supplying the sheets is automatically selected among the plural trays, based on predetermined rules. In this example, for serving as a copier of the document, a tray is selected which accommodates sheets whose size is the same as the size of the document, and from which the sheets are supplied. For serving as a printer, image size information is selected from received image data, and a tray is selected which accommodates the sheets whose size is the same as said selected information, and from which the sheets are supplied. Said automatic tray selection function is obtained by the operation of control section 103.

When the automatic tray selection function is used, "automatic tray selection" of button 121*b* is displayed, while the text color is reversed from black to white, or vise versa, and a tray is selected in the order of descending priority, which will be detailed later, the selected tray is then displayed while the text color is reversed. When the automatic tray selection function is not used, "automatic tray selection" of button 121*b* is returned to the normal display, the user touches a desired tray number so that the touched one is displayed, while the text color is reversed, whereby the selection of the tray is completed.

Figure 5:
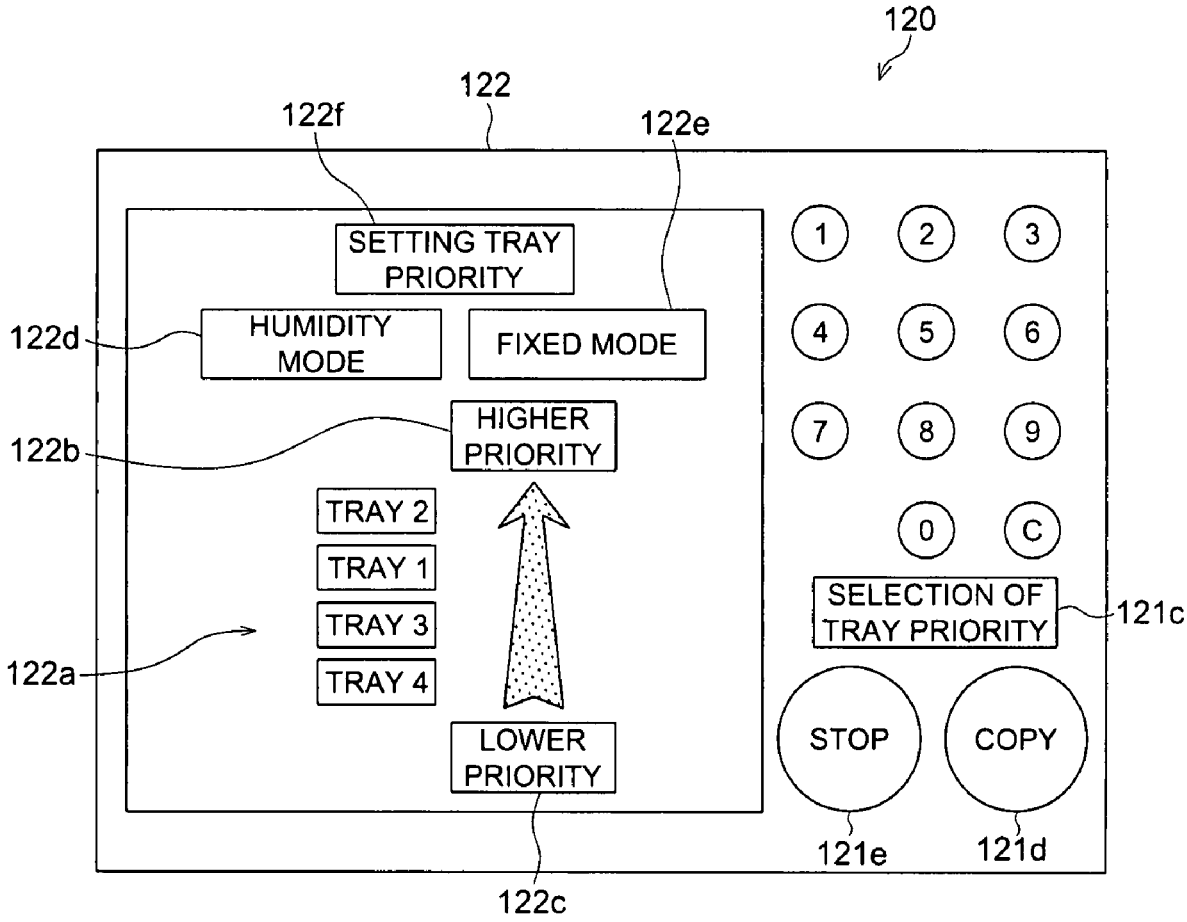
FIG. 5 shows an operational section of the present invention, on which a screen for assigning the priority to the tray is displayed.

Further, it is necessary for the user that the user previously determines the priority to be assigned to the trays. When the user touches "tray priority selection" button 121*c*, the touch display changes to display tray priority assigning screen 122, as shown in FIG. 5. In addition, copy button 121*d* in FIG. 4 is a button for inputting instructions of image formation.

On tray priority assigning screen 122 in FIG. 5, tray 2 has been assigned as first priority in tray priority section 121*a*. If the user wants to assign tray 4 as first priority and to keep the other trays without change, the user touches "tray 4", while the text color is reversed, after which the user touches "higher priority" button 121*b* for three times, then the display of tray 4 shifts to be the first priority. On the other hand, if the user touches "tray 2", while the text color is reversed, and touches "lower priority" button 122*c*, the priority of tray 2 is decreased in accordance with the number of touches. As described above, the priority assigned to the trays to be automatically selected is assigned by operation section 120, and assigned priority information is sent to control section 103. Control section 103 stores said priority in the nonvolatile memory device, such as flash memory.

The automatic tray selecting function includes a humidity mode in which the humidity of the sheet is considered, and a fixed mode in which a tray is automatically selected based on only the tray priority which the user instructs on tray priority assigning screen 122. In the humidity mode, if a tray of a highest priority assigned by the user exhibits very high humidity, as well as if a tray of the second priority is at a lower humidity, the second priority tray is automatically selected. If the highest priority tray is at a lower humidity, which is automatically selected, as a matter of course. The humidity mode or the fixed mode are set by pressing humidity mode button 121*d* or fixed mode button 122*e*.

While the tray priority assigning screen is displayed, and if "tray priority assigning" button 122*f* is pressed, the screen returns to the normal screen showing the changed priority shown in FIG. 4.

Further, the user can replace the accommodated sheets in each tray so that the sheet type is changed, but it is necessary for the user to set the changed sheet type accommodated in the tray.

Figure 6:
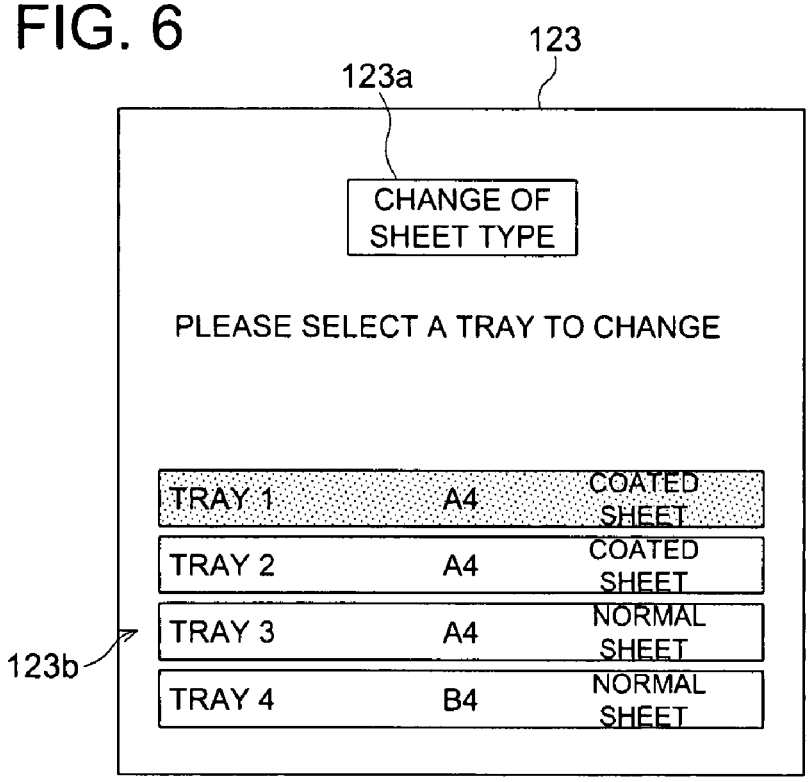
FIG. 6 shows an operational section of the present invention, on which a screen for setting the sheet type is displayed.

Via sheet type changing screen 123, shown in FIG. 6, the user can change the sheet type of the sheets accommodated in the tray. The user can change the display from the setting menu screen to the sheet type changing screen 123, while it is being displayed on operation section 120. When the user selects a tray to be changed, from among tray selecting column 123*b* on sheet type changing screen 123, sheet type selecting screen 124 is displayed. Additionally, when the user presses sheet type changing button 123*a* on sheet type changing screen 123, the screen returns to the preceding screen, such as a setting menu screen, showing the changed setting.

Figure 7:
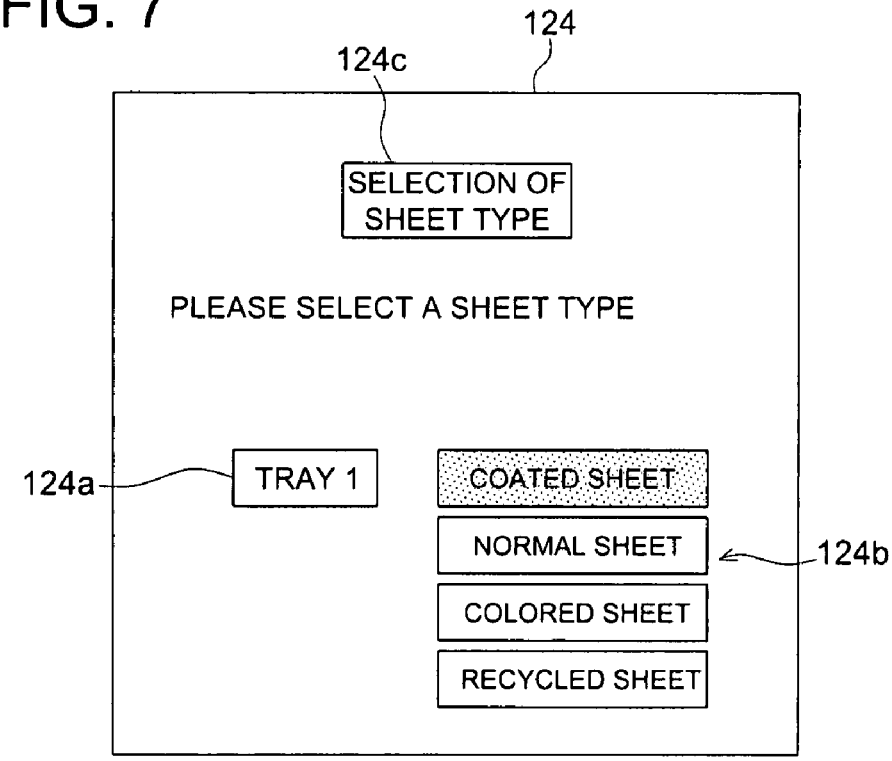
FIG. 7 shows another operational section of the present invention, on which a screen for changing the sheet type is displayed.

On sheet type selecting screen 124 shown in FIG. 7, the tray selected on the previous screen is displayed on tray display column 124*a*, while selectable sheet types are displayed on sheet type list column 124*b*. When the user presses a desired button, among the plural sheet type buttons displayed on sheet type list column 124*b*, said button is displayed while the text color is reversed from the normal. After the user selects a sheet type, the user presses sheet type selecting button 124*c*, the screen returns to the previous screen, showing the selected sheet type in the tray.

Next, the dehumidifying control based on the humidity in each tray will be detailed.

Figure 8:
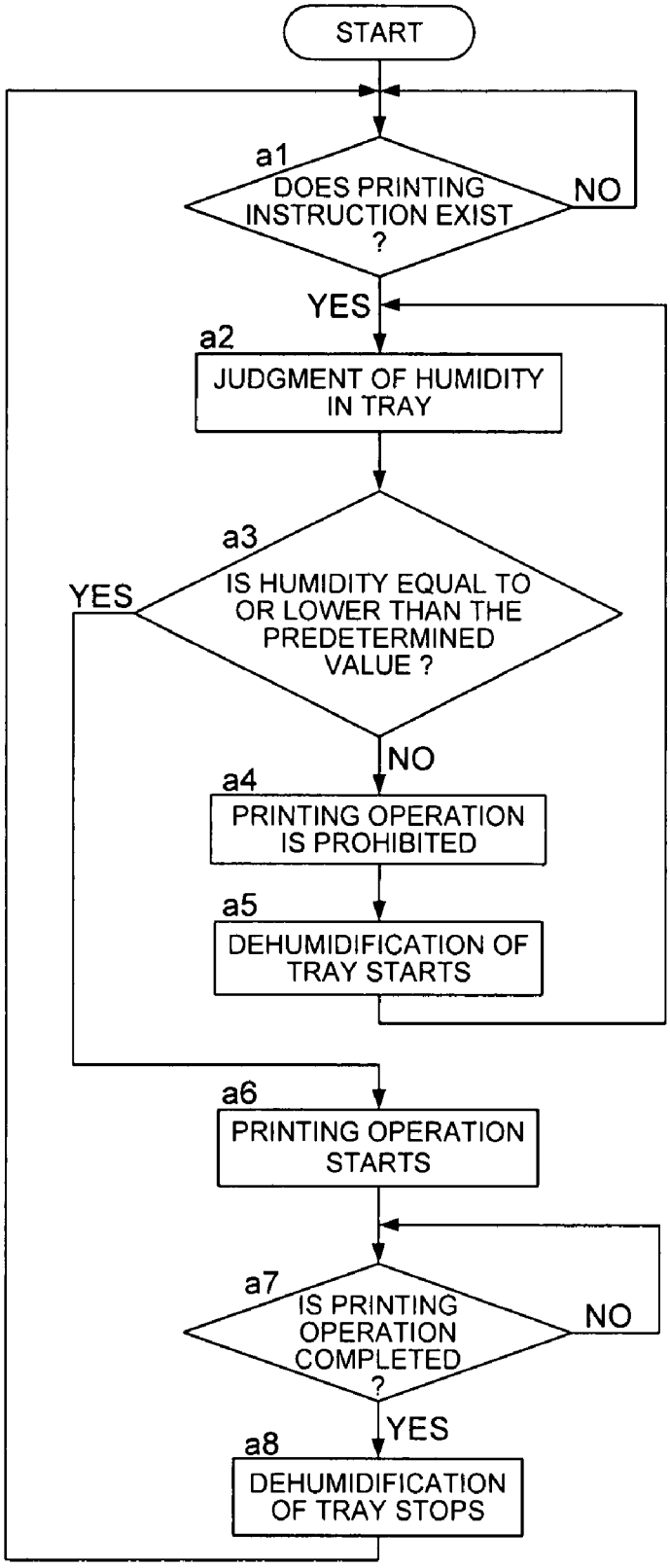
FIG. 8 is a flow chart for printing of the present invention, on which when the humidity inside the tray is equal to or lower than a predetermined value.

Embodiment 1 see FIG. 8

In the tray which supplies the sheets for image formation, when the humidity inside the tray is equal to or lower than the predetermined value, the control to conduct printing is explained while referring to FIG. 8.

Control section 103 awaits printing instructions, such as pressing signal of the copy button on operation section 120 (step a1), and when the printing instruction is entered, control section 103 judges the humidity inside the tray which is to supply the sheets (step a2). Specifically, the humidity and the temperature are detected by external humidity sensor 80, external temperature sensor 81 and tray temperature sensor 73, and the detected results are sent to control section 103. Based on the detected results, control section 103 calculates a target temperature inside the tray to be attained inside the tray as the predetermined humidity value. If the temperature in the tray is higher than the targeted temperature, control section 103 judges that the humidity inside the tray is equal to or lower than the predetermined value, while when the temperature in the tray is equal to or lower than the targeted temperature, control section 103 judges that the humidity inside the tray is higher than the predetermined value. When judgment is that the humidity inside the tray is equal to or lower than the predetermined value (Yes in step a3), dehumidifying control is not necessary so that printing is conducted (step a6). On the other hand when judgment is that the humidity inside the tray is higher than the predetermined value (No in step a3), printing is prohibited (step a4), and control section 103 controls dehumidifying device 130 to start the dehumidifying operation for that tray (step a5). Simultaneously to the start of dehumidifying operation, the humidity inside the tray is continuously judged, and the dehumidifying operation is continued until the humidity of the tray decreases to be equal to or lower than the predetermined value (step a3). When the humidity inside the tray reaches to be equal to or lower than the predetermined value (Yes in step a3), control section 103 conducts printing (step a6), and when printing is completed (Yes in step a7), control section 103 deactivates dehumidifying device 130 (step a8).

That is, when printing is instructed, if the humidity inside the tray is equal to or lower than the predetermined value, printing is immediately conducted, while if the humidity inside the tray is higher than the predetermined value, printing is conducted only after the dehumidifying operation, whereby paper jams due to high humidity are prevented, and printing is started immediately after the dehumidification, which can reduce the waiting time.

The control process after receiving the printing instructions is explained in the above procedure, however, without these printing instructions, after conducting the above steps a2-a5, the humidity inside the tray is controlled so that the apparatus is maintained in the printable condition. In this case, when the printing instruction is entered, printing is immediately started without waiting for any dehumidifying operation.

Figure 9:
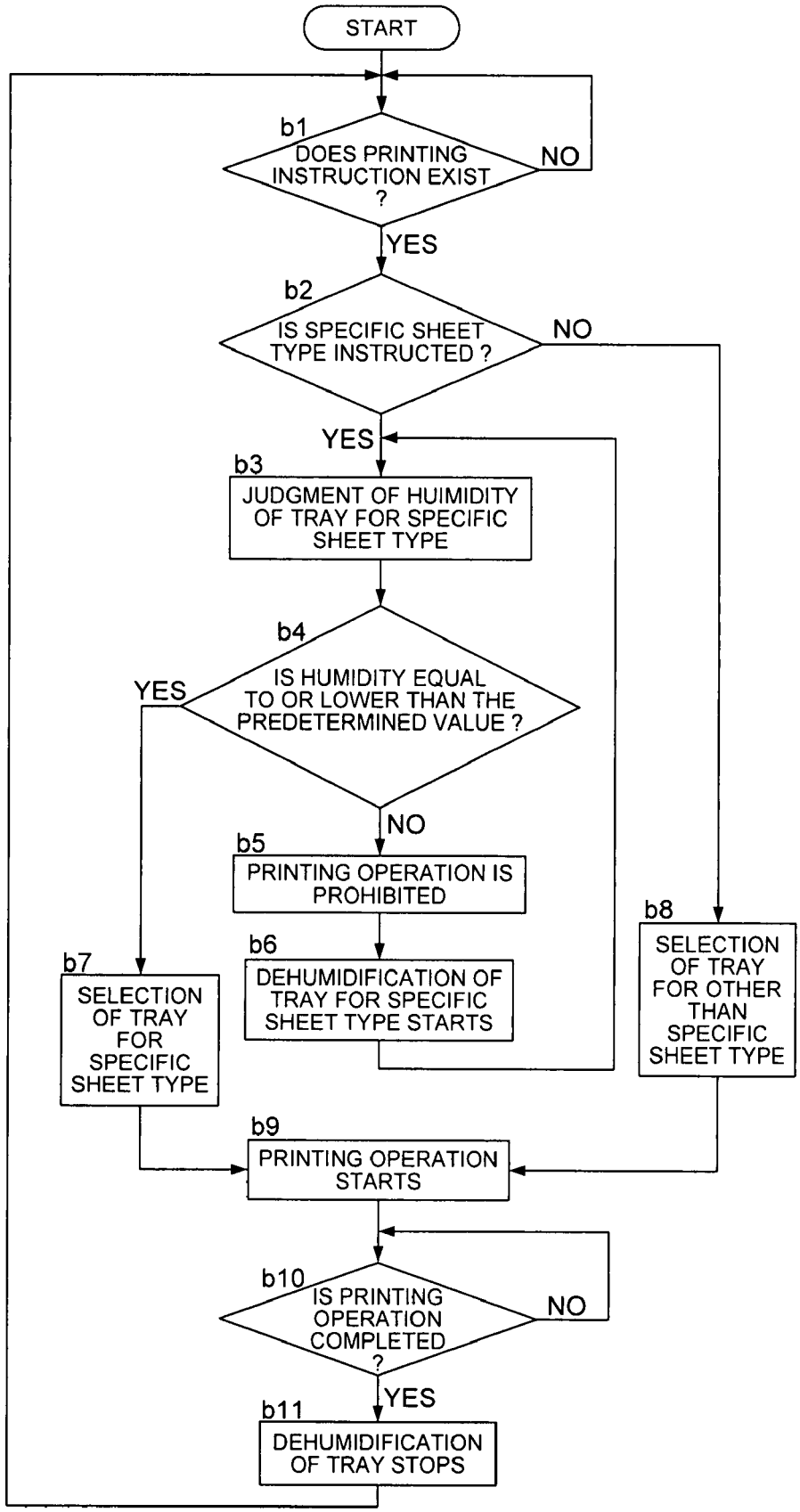
FIG. 9 is a flow chart for selecting a tray, based on a sheet type of the recording sheet, of the present invention.

Embodiment 2, see FIG. 9

In the above description, the type of sheet is not considered, however present embodiment 2 shows another control method in which the sheet type is considered. That is, the type of sheet to be accommodated in each tray is registered by operation section 120. Further, the coated sheets, which cause problems in high humidity environments, are registered as specific sheet types. If the printing instruction includes a specific sheet type, or if the user instructs a tray accommodating a specific sheet type, via operating section 120, control section 103 controls to select the tray accommodating the specific sheet type. Further, when the specific sheet type is selected, control steps being the same as steps a1-a8 of embodiment 1 are conducted so that any problem due to high humidity can be overcome. On the other hand, when sheets other than the specific sheet types are instructed to be used, no problems occur due to high humidity so that printing can be conducted without judging the humidity inside the tray, which enables high speed printing.

Control procedure of embodiment 2 will now be detailed while referring to FIG. 9. Control section 103 awaits printing instructions, such as the pressing signal of "copy" button via operation section 120 (step b1), when the printing instruction is entered, control section 103 judges whether any specific sheet type is instructed to be used (step b2). If no specific sheet type exists (No in step b2), control section 103 selects the tray accommodating sheets other than the specific sheet types (step b8), and controls to conduct printing (step b9). If the specific sheet type is instructed to be used (Yes in step b2), control section 103 judges the humidity inside the tray which accommodates the specific sheet type (step b3), and judges whether the humidity inside the trays is equal to or lower than the predetermined value (step b4). If the judged result is that the humidity is equal to or lower than the predetermined value (Yes in step b4), dehumidifying control is not necessary, and control section 103 selects the tray accommodating the specific sheet type (step b7), and starts printing (step b9). On the other hand, if control section 103 judges that the humidity inside the tray is higher than the predetermined value (No in step b4), control section 103 controls image forming section 106 to prohibit printing (step b5), and controls dehumidifying device 130 to start dehumidifying operation (step b6). Simultaneously with the start of the dehumidifying operation, the humidity inside the tray is continuously judged, and the dehumidifying operation is continued until the humidity inside the tray decreases to be equal to or lower than the predetermined value (step b4). When the humidity inside the tray reaches to be equal to or lower than the predetermined value (Yes in step b4), control section 103 selects the tray accommodating the specific sheet type (step b7), and conducts printing (step b9), and when printing is completed (Yes in step b10), control section 103 deactivates dehumidifying device 130 (step b11).

Figure 10:
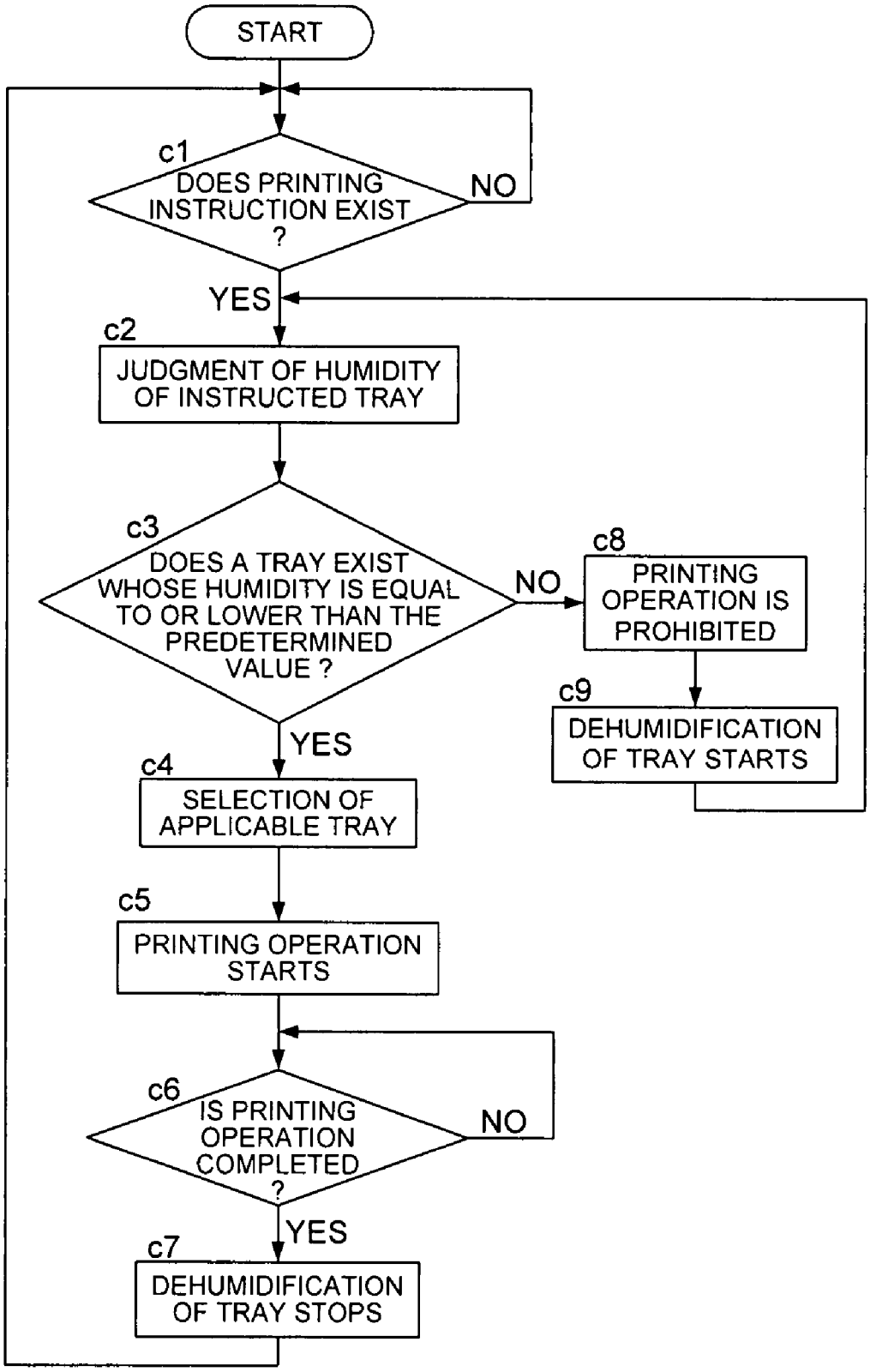
FIG. 10 is a flow chart of the present invention, for conveying the sheets from the dehumidified tray, based on the priority assigned to the tray.

Embodiment 3, see FIG. 10

In embodiment 3, plural trays are provided which accommodate sheets of the same size, wherein without waiting for the completion of dehumidification of a single tray, a dehumidified tray among the plural trays is selected so that printing can start more quickly.

The control procedure of embodiment 3 will be detailed while referring to FIG. 10. When the printing instruction is entered (step c1), and if plural trays have been installed, which accommodate sheets of the same size as the instructed size, control section 103 judges the humidity of each tray (step c2). Based on the judged result, control section 103 judges whether a tray exists the humidity inside of which is equal to or lower than the predetermined value among the plural trays (step c3). If such a tray exists (Yes in step c3), control section 103 selects said tray (step c4), and conducts printing (step c5). If it does not exist (No in step c3), control section 103 controls to prohibit printing (step c8), and controls the dehumidifying devices to dehumidify the tray (step c9). Control section 103 continuously judges the humidity in each tray, and judges whether a tray exists which has the humidity lower than the predetermined value (step c3). If the dehumidifying operation of any one of the trays is completed and the humidity inside said tray is equal to or lower than the predetermined value (Yes in step c3), control section 103 selects said tray (step c4), and starts printing (step c5). After printing is completed (Yes in step c6), control section 103 deactivates dehumidifying devices 130 (step c7).

Figure 11:
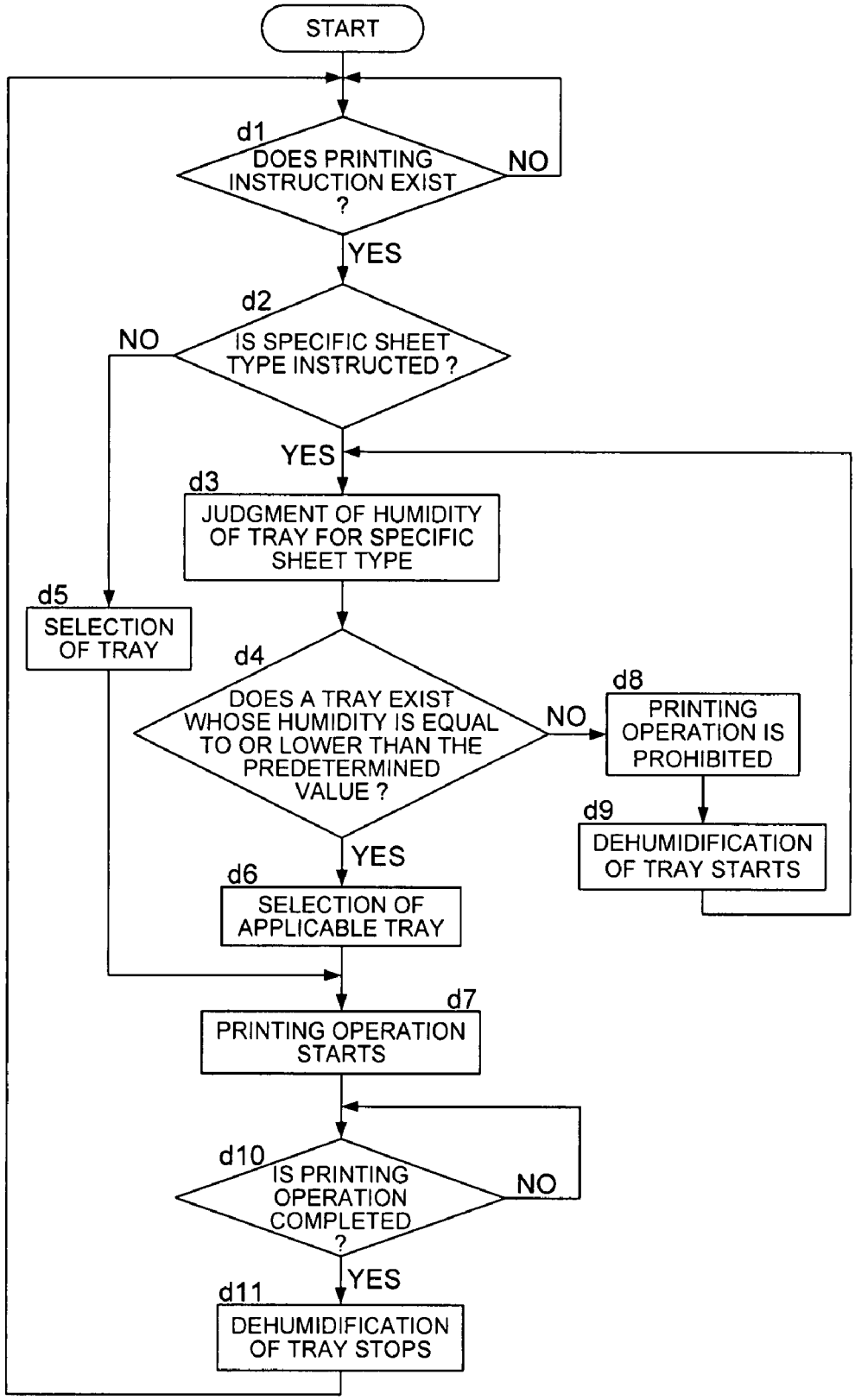
FIG. 11 is a flow chart of the present invention, wherein a predetermined sheet type has been set.

Embodiment 4, see FIG. 11

In above-described embodiment 3, for starting printing, in a case that a specific sheet type is instructed for printing under the humidity equal to or lower than the predetermined value, and when the humidity inside the tray accommodating the specific sheet type is equal to or lower than the predetermined value, said tray is selected. The specific sheet types tend to create problems of printing under high humidity, which problems disappear by printing under lower humidity. If sheet type other than the specific type is instructed to be used, such sheet creates no problem under high humidity, so that that tray is selected regardless of the humidity inside the tray.

The control procedure of the above method will be detailed below, while referring to FIG. 11. When the printing instruction is entered (step d1), control section 103 judges whether a specific sheet type is instructed to be used (step d2). If no specific sheet type is instructed to be used (No in step d2), control section 103 selects a tray which accommodate sheets other than the specific sheet type (step d5), and conducts printing (step d7). If the specific sheet type is instructed to be used (Yes in step d2), control section 103 judges the humidity in each tray which accommodates specific sheet type (step d3), and judges whether the humidity inside the tray is equal to or lower than the predetermined value (step d4). If the humidity inside the tray is equal to or lower than the predetermined value (Yes in step d4), dehumidifying control is not necessary, and control section 103 selects a tray whose humidity is equal to or lower than the predetermined value (step d6), and conducts printing (step d7). On the other hand, if the humidity inside the tray is not equal to or lower than the predetermined value (No in step d4), control section 103 inhibits printing (step d8), and controls dehumidifying device 130 to start dehumidify the trays (step d9). Simultaneously to the start of the dehumidifying operation, the humidity inside the tray is continuously judged, and the dehumidifying operation is continued until the humidity inside the tray decreases to be equal to or lower than the predetermined value (step d4). When the humidity inside the tray reaches to be equal to or lower than the predetermined value (Yes in step d4), control section 103 selects said tray (step d6), and conducts printing (step d7), and when printing is completed (Yes in step b10), control section 103 deactivates dehumidifying device 130 (step d11).

Figure 12:
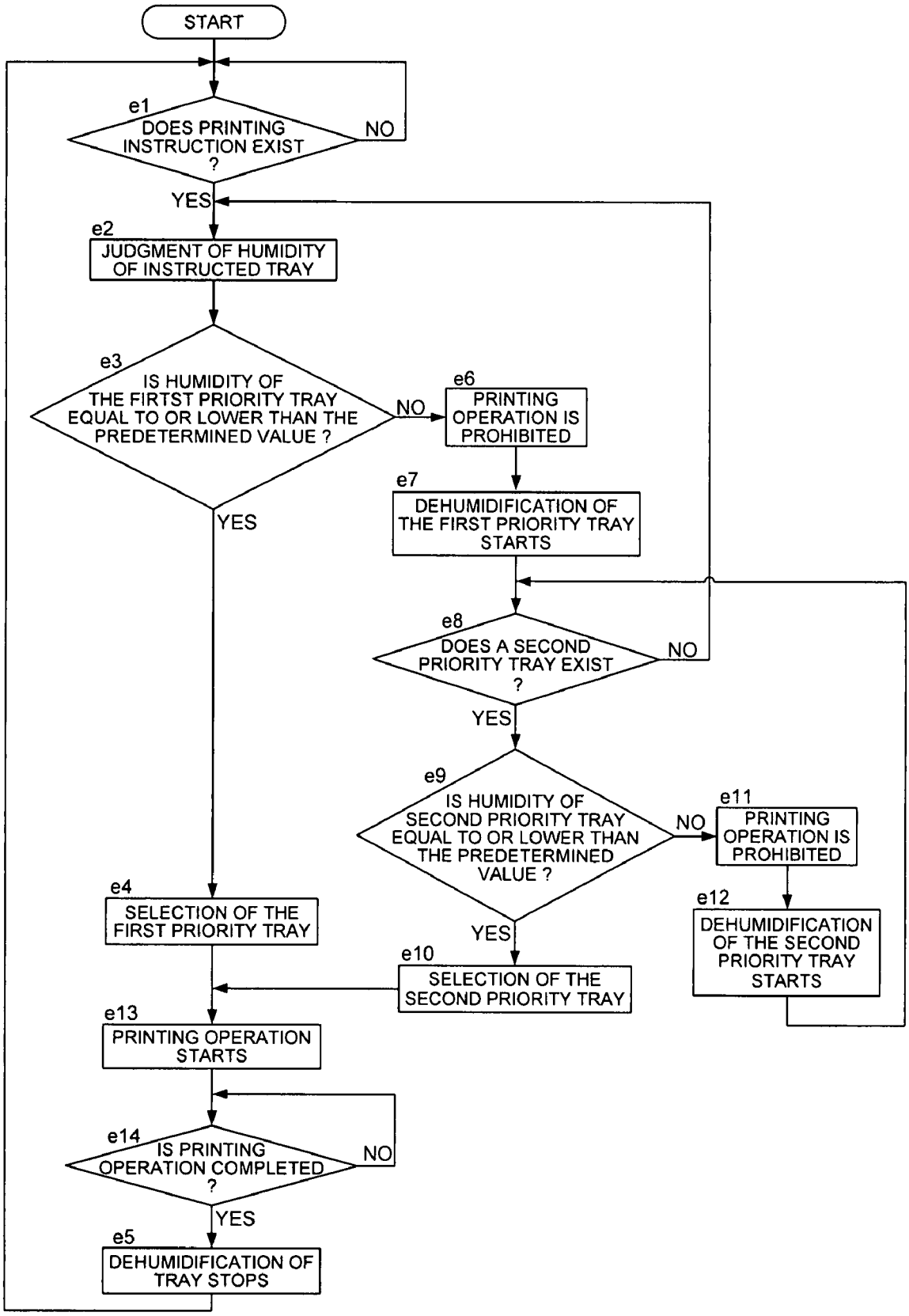
FIG. 12 is a flow chart for selecting a tray based on the priority assigned to the trays, of the present invention.

Embodiment 5, see FIG. 12

When a tray is to be automatically selected, and if there are the possible plural trays for selection, it is possible to select an appropriate tray, while referring to the priority assigned to the trays. Such control will be detailed while referring to FIG. 12. In the explanation below, as an example, priority is assigned for three trays.

Control section 103 awaits printing instruction (step e1), and when the printing instruction is entered (Yes in step e1), control section 103 judges the humidity in the plural trays which accommodate sheets whose size is specified in the printing instructions (step e2). Next, among the possible plural trays for selection, control section 103 judges whether the humidity inside the first priority tray is equal to or lower than the predetermined value (step e3). If the humidity inside the first priority tray is equal to or lower than the predetermined value (Yes in step e3), control section 103 selects the first priority tray (step e4), and conducts printing (step e13). On the other hand, if the humidity inside the first priority tray is higher than the predetermined value (No in step e3), control section 103 inhibits printing (step e6), and starts dehumidifying operation for the first priority tray (step e7). Next, control section 103 judges whether a second priority tray exists or not (step e8). If no second priority tray exists (No in step e8), the procedure returns to step e2, and control section 103 continuously judges whether the humidity inside the first priority tray is equal to or lower than the predetermined value. If the second priority tray exists (Yes in step e8), control section 103 judges whether the humidity inside the second priority tray is equal to or lower than the predetermined value (step e9). If the judgment is positive (Yes in step e9), control section 103 selects the second priority tray (step e10), and conducts printing operation (step e13). On the other hand, if the humidity inside the second priority tray is higher than the predetermined value (No in step e9), control section 103 prohibits the printing operation (step e11), and starts the dehumidifying operation of the second priority tray (step e12). Next, the procedure returns to step e8, control section 103 judges the humidity of trays of a third, fourth, - - - priority, and continues the above procedures until all candidates have been judged. When printing is completed (step e13), control section 103 stops dehumidifying operation for the trays (step e5). As time passes, the humidification of each tray proceeds. Accordingly, by repeating the above procedures, trays are selected for printing based on priority parameters, whose humidity is equal to or lower than the predetermined value.

Figure 13:
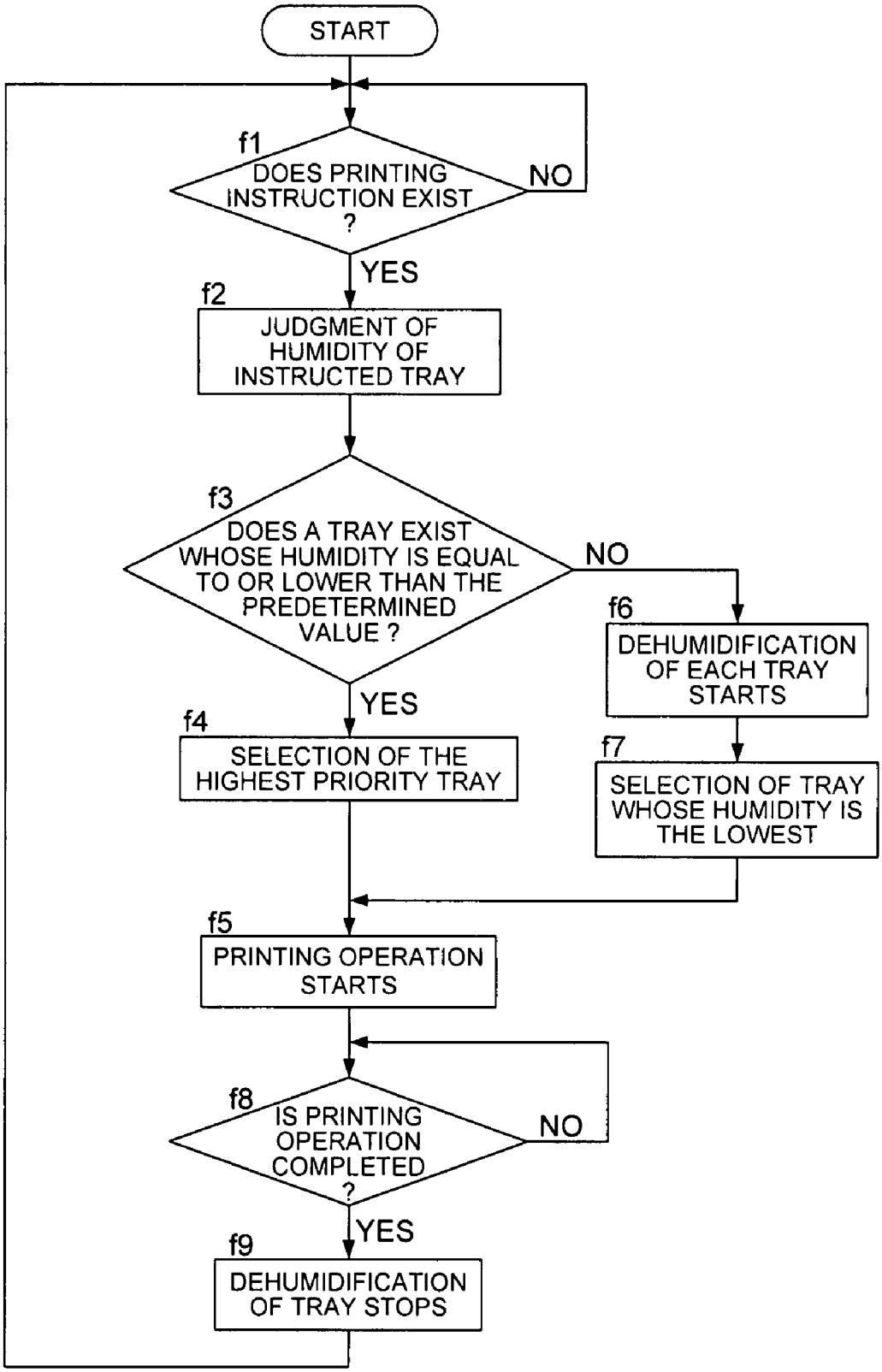
FIG. 13 is a flow chart of the present invention, for selecting a tray before the humidity inside the tray is lowered to less than the predetermined value, and conducting printing

Embodiment 6, see FIG. 13

In the above procedures, printing operation is conducted after the humidity of each tray reaches to be equal to or lower than the predetermined value. However, by the procedure of embodiment 6, it is possible to conduct the printing operation before the humidity reaches the predetermined value, which is effective in saving operation time.

The control of the above procedure will be detailed while referring to FIG. 13. Control section 103 awaits printing instruction (step f1), and when it is entered (Yes in step f1), control section 103 judges the humidity of each tray (step f2), after which control section 103 judges whether a tray exists the humidity inside of which is equal to or lower than the predetermined value (step f3). If yes (Yes in step f3), control section 103 selects the tray of the highest priority (step f4), and conducts the printing operation (step f5). On the other hand, if no tray exists the humidity inside of which is equal to or lower than the predetermined value (No in step f3), control section 103 starts the dehumidification of each tray (step f6), and selects a tray the humidity inside of which is the lowest (step f7), to conduct the printing operation (step f5). For printing, it can be assumable that the humidity of said tray will be promptly decreased by the dehumidifying operation to be equal to or lower than the predetermined value, so that the problems due to the high humidity will not be risky. Further, it is can also be assumable that the humidity inside the tray will decrease while printing operation is conducted for plural sheets. When the printing operation is completed (Yes in step f8), control section 103 stops the printing operation (step f9).

Figure 14:
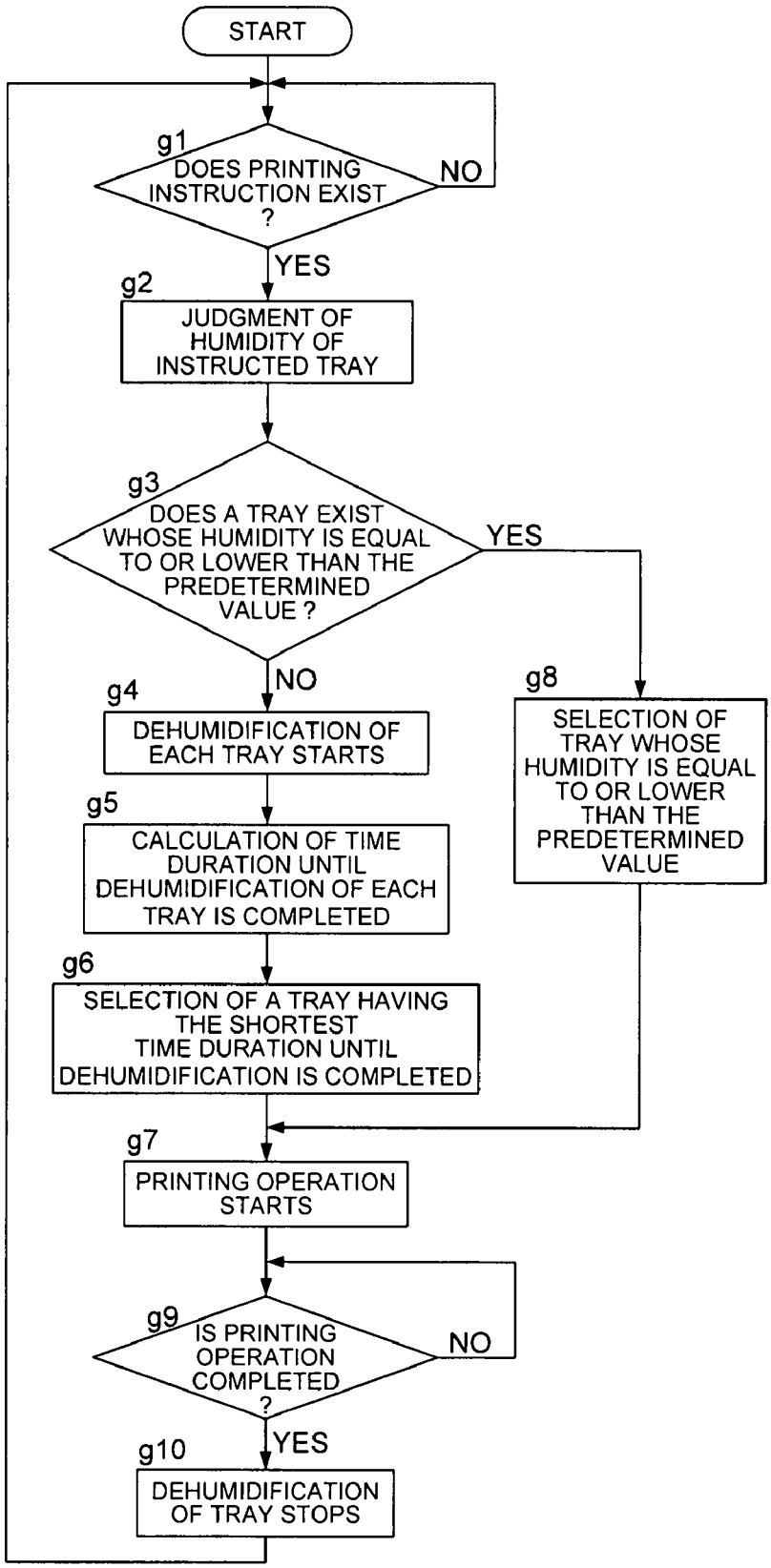
FIG. 14 is a flow chart of the present invention, for selecting a tray whose estimated time for the completion of the dehumidification is the shortest.

Embodiment 7, see FIG. 14

In this embodiment, estimated time, during which the humidity inside the tray changes from a present value to the predetermined value, is calculated for each tray, so that a tray having the shortest estimated time is selected among the calculated estimated times, and the printing operation is conducted so that wasteful waiting time during which humidity reaches the predetermined value can be omitted, and the printing operation can be promptly completed. Further, it is possible to assume for such tray that the humidity inside the tray can be promptly reduced to become equal to or lower than the predetermined value by the dehumidification, so that the problems due to high humidity can be the smallest. The estimated time can be correctly judged while referring to not only the present humidity inside the tray but also the rise in the temperature of each tray. The temperature rise is dependent on the volume of the tray, the volume of remaining sheets, the sheet type, and the sheet weight classification.

The contents of this control will be detailed while referring to FIG. 14. Control section 103 awaits printing instruction (step g1), and when it is entered (Yes in step g1), control section 103 judges the humidity of each tray (step g2), after which control section 103 judges whether a tray exists the humidity inside of which is equal to or lower than the predetermined value (step g3). If such a tray exists (Yes in step g3), control section 103 selects said tray (step g8), and conducts the printing operation (step g7). On the other hand, if no tray exists the humidity inside of which is equal to or lower than the predetermined value (No in step g3), control section 103 starts the dehumidification of each tray (step g4), after which control section 103 calculates the estimated time to complete the dehumidification inside each tray (step g5), and selects the tray having the shortest estimated time (step g6), to conduct the printing operation (step g7). When printing is completed (Yes in step g9), control section 103 deactivates dehumidifying device 130 of said tray (step g10).

Figure 15:
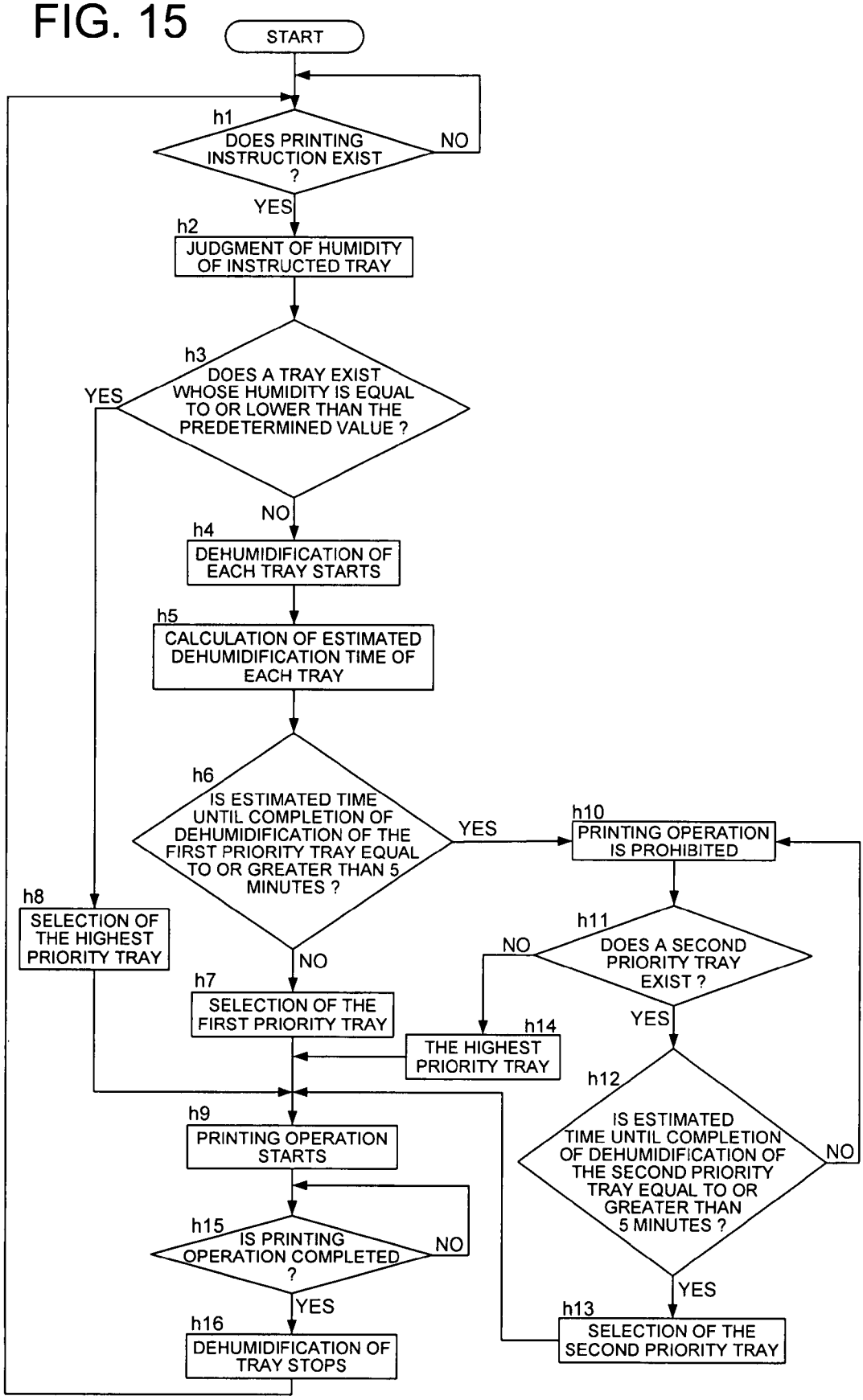
FIG. 15 is a flow chart of the present invention, for selecting a tray, based on whether the estimated time is shorter than the predetermined time as the standard, when a specific tray is selected based on the priority assigned to the trays.

Embodiment 8, see FIG. 15

In addition to the above embodiment, when the tray is to be selected based on the priority regarding the estimated time, it is also possible to select a tray, based on whether the estimated time is longer or shorter than a standard time (for example, 5 minutes), which will be detailed while referring to FIG. 15.

Control section 103 awaits printing instruction (step h1), and when it is entered (Yes in step h1), control section 103 judges the humidity of each tray (step h2), after which control section 103 judges whether a tray exists the humidity inside of which is equal to or lower than the predetermined value (step h3). If such trays exist (Yes in step h3), control section 103 selects a tray having the highest priority among them (step h8), and conducts the printing operation (step h9). On the other hand, if no tray exists the humidity inside of which is equal to or lower than the predetermined value (No in step h3), control section 103 starts dehumidification of each tray (step h4), and then control section 103 calculates the estimated time for completing the dehumidification inside each tray (step h5). Next, based on the calculated results, control section 103 judges whether the estimated time of the first priority tray is equal to or longer than the standard time (for example, 5 minutes)(step h6). If the estimated time of the first priority tray is shorter than, for example, 5 minutes (Yes in step h6), control section 103 selects the first priority tray (step h7), and conducts the printing operation (step h9). On the other hand if the estimated time of the first priority tray is equal to or longer than, for example, 5 minutes (No in step h6) control section 103 prohibits the printing operation (step h10), and judges whether a second priority tray exists (step h11). If no such tray does exist (No in step h11), control section 103 selects a highest priority tray among them (step h14), and conducts the printing operation (step h9). If it exists (Yes in step h11), control section 103 judges whether the estimated time of the second priority tray is equal to or longer than the standard time, for example, 5 minutes (step h12). If the estimated time of the second priority tray is shorter than 5 minutes (Yes in step h12), control section 103 selects said second priority tray (step h13), and conducts printing operation (step h9). If the estimated time of the second priority tray is equal to or longer than 5 minutes (No in step h12), control section 103 prohibits the printing operation (step h10), and the procedure returns to step h11, after which control section 103 continues the judging procedure to determine whether the estimated time of any other trays with respect to the priority is equal to or longer than the standard time, until all trays have been judged. When printing is completed (Yes in step h15), control section 103 deactivates dehumidifying device 130 of the tray which is still being dehumidified (step h16).

Figure 16:
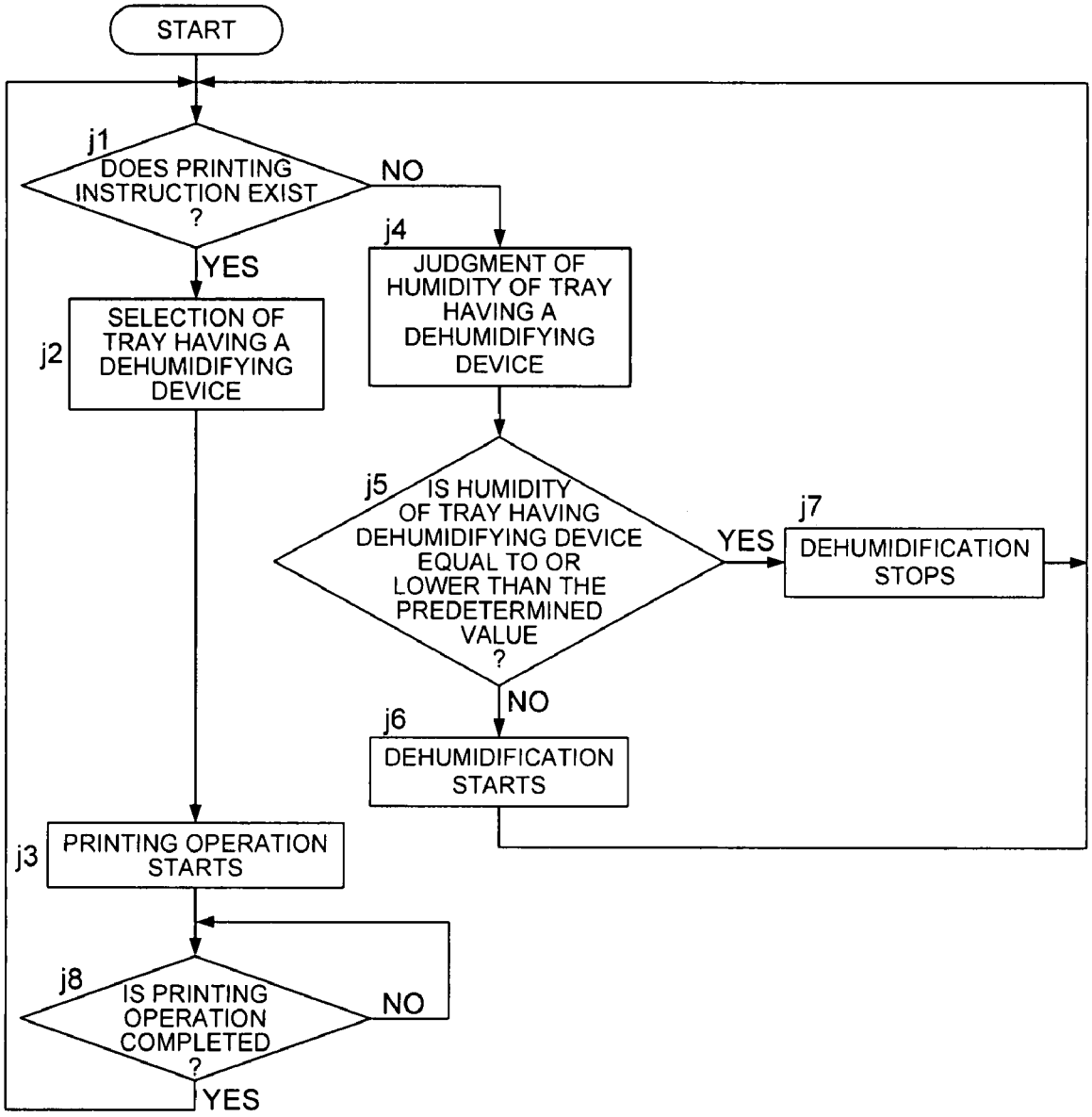
FIG. 16 is a flow chart of the present invention, on which only some of the trays among the plural trays feature the dehumidifying function.

Embodiment 9, see FIG. 16

In above-described embodiments 1-8, each tray has dehumidifying function incorporating a dehumidification device and a humidity detecting unit. In present embodiment 9, only some of the trays among the total trays have the dehumidifying function, which results in reduction of overall apparatus cost.

FIG. 16 shows a control procedure wherein several trays incorporate the dehumidification function. Control section 103 awaits printing instruction (step j1), and if none are entered (No in step j1), control section 103 judges the humidity of all trays incorporating the dehumidification function (step j4), and judges whether the judged humidity is equal to or lower than the predetermined value (step j5). If it is not (No in step j5), control section 103 starts dehumidification (step j6). If it is, (Yes in step j5), control section 103 stops dehumidification (step j7). The procedure then returns to step j1, and repeats the above procedure until printing instruction is entered, and maintains the humidity of trays incorporating the dehumidification function to be equal to or lower than the predetermined value. Due to this procedure, the tray having been dehumidified is always present. When printing instruction is entered (Yes in step j1), control section 103 controls image forming section 106 to conduct printing operation (j3). When the printing operation has been completed (Yes in step j8), the procedure returns to step j1. Accordingly, trays of controlled humidity can be positively used so that the problems due the humidity are overcome.

Figure 17:
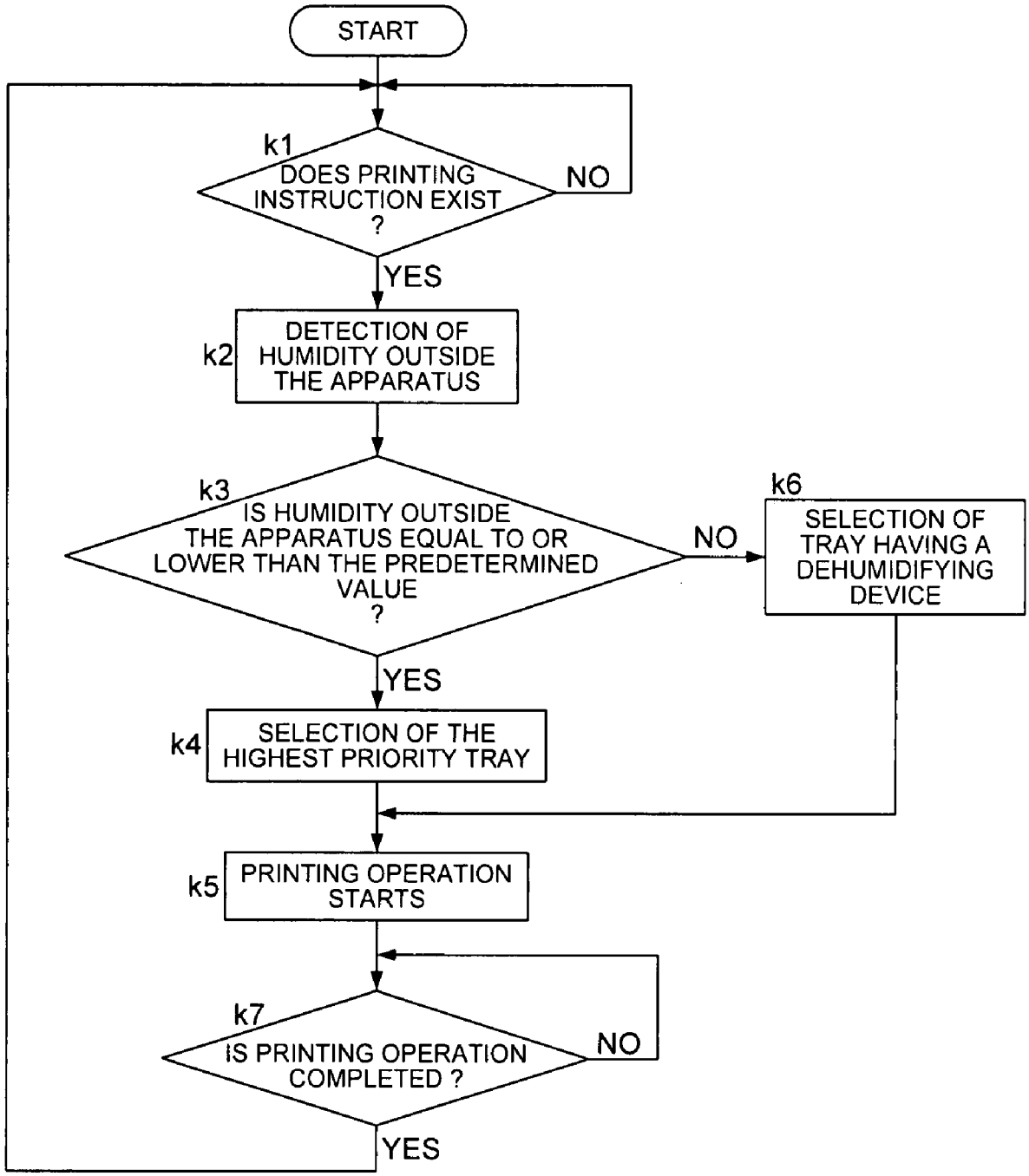
FIG. 17 is a flow chart of the present invention, for selecting trays featuring the dehumidifying function, based on the previously assigned priority, when the trays featuring the dehumidifying function are selected by priority.

Embodiment 10, see FIG. 17

When trays incorporating the dehumidification function are selected by priority, they are selected in accordance with the assigned priority of all trays. In this case, if the ambient humidity outside the apparatus is equal to or lower than the predetermined value, they are selected in accordance with the priority assigned to the trays which are assigned from among all trays, while if the ambient humidity outside the apparatus is higher than the predetermined value, they are selected in accordance with the priority assigned to the trays from among the trays incorporating the dehumidification function.

FIG. 17 shows the above control procedure. Control section 103 awaits printing instruction (step k1), and if printing instruction is entered (Yes in step k1), control section 103 judges the humidity outside the apparatus by the external humidity sensor (step k2), and judges whether the judged humidity is equal to or lower than the predetermined value (step k3). If it is not (No in step k3), control section 103 selects the tray incorporating a dehumidification function (step k6), and conducts the printing operation (step k5). If the humidity is equal to or lower than the predetermined value (Yes in step k3), control section 103 selects the tray having the highest priority (step k4), and conducts the printing operation (step k5). When the printing operation has been completed (Yes in step k7), the procedure returns to step k1. Accordingly, the trays incorporating the dehumidification function are selected by priority, and thereby, even in the high humidity environments, humidity problems will be effectively controlled.

Figure 18:
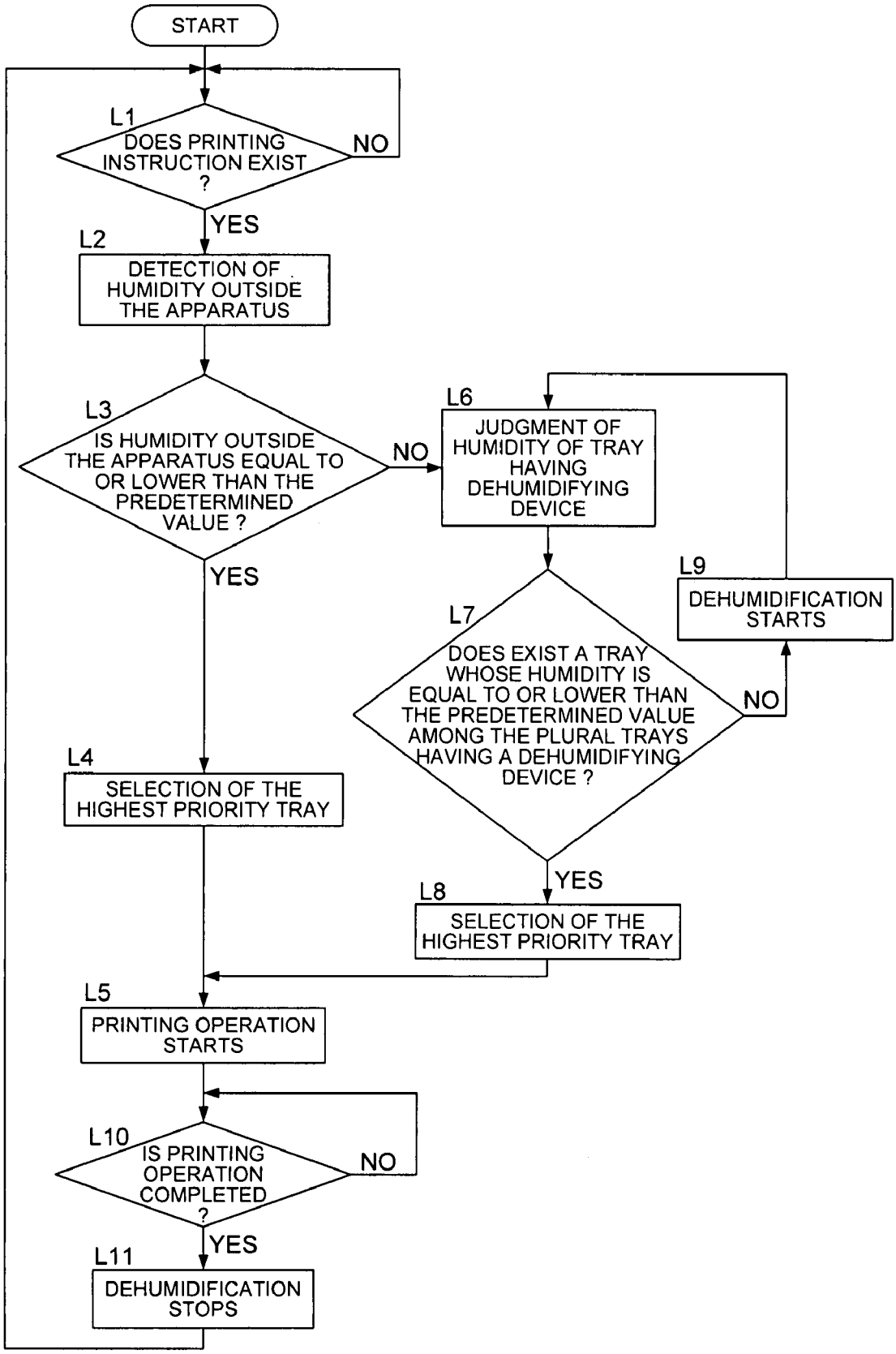
FIG. 18 is a flow chart of the present invention, for selecting a tray featuring the dehumidifying function and whose humidity is equal to or lower than the predetermined value, when the tray featuring the dehumidifying function is selected.

Embodiment 11, see FIG. 18

When a tray incorporating the dehumidification function is to be selected in the above procedure, it is preferable that a tray the humidity inside of which is lower than the predetermined value is selected from among the trays incorporating the dehumidification function.

FIG. 18 shows this control procedure. Control section 103 awaits printing instruction (step L1), and if the printing instruction is entered (Yes in step L1), control section 103 judges the ambient humidity outside the apparatus by the external humidity sensor (step L2), and judges whether the judged humidity is equal to or lower than the predetermined value (step L3), if the humidity is equal to or lower than the predetermined value (Yes in step L3), then control section 103 selects the tray of the highest priority (step L4), and conducts printing operation (step L5). If the humidity is higher than the predetermined value (No in step L3), the control section judges the humidity of the trays incorporating the dehumidifying function (step L6), and judges whether the trays the humidity inside of which are equal to or lower than the predetermined value exists among the trays incorporating the dehumidifying function (step L7). If it is yes (Yes in step L7), control section 103 selects the tray of the highest priority from among them (step L8), and conducts the printing operation (step L5). If it is no (No in step L7), control section 103 starts the dehumidifying operation (step L9), and the procedure returns to step 6, and control section 103 continues the above judgment operation until the dehumidification is completed. When the printing operation is completed (Yes in step L10), control section 103 stops the dehumidification (step L11). Due to the above procedure, when control section 103 selects the trays incorporating the dehumidifying function, control section 103 can select the trays the humidity inside of which are equal to or lower than the predetermined value, from among the trays incorporating the dehumidifying function, so that the problems caused by the high humidity are overcome.

Figure 19:
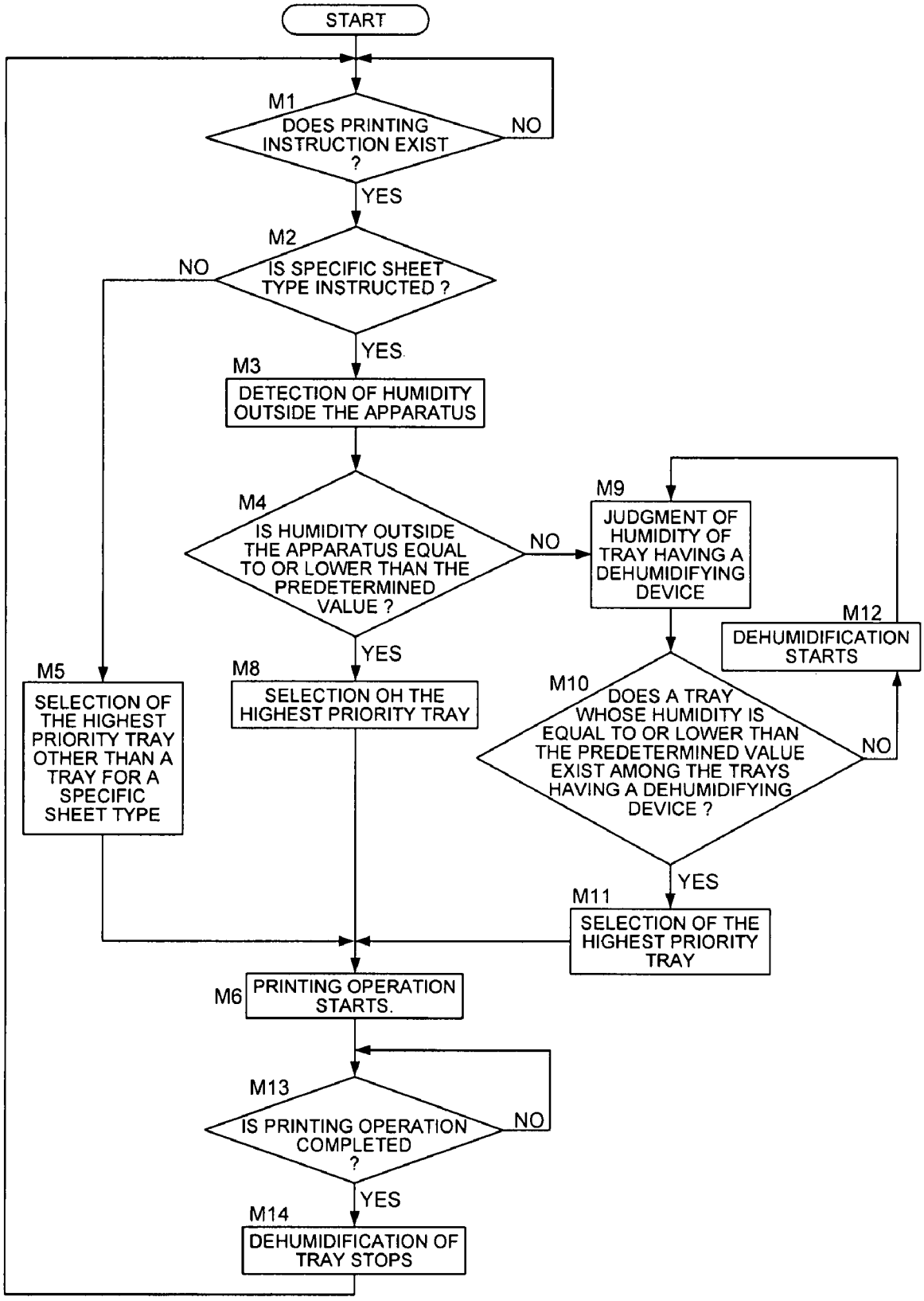
FIG. 19 is a flow chart of the present invention, wherein a specific sheet type has been instructed for printing, with regard to humidity.

Embodiment 12, see FIG. 19

Further, when the specific sheet type, which is to be used while considering the humidity, has been instructed, said sheet type has no problem in the high humidity environments, but when the normal sheet, being not the specific sheet type, has been instructed to be used, the trays are selected in accordance with the priority of the assigned trays. On the other hand, when the coated sheet as the specific sheet type has been instructed, which causes the problems under the high humidity environments, whereby it is preferable that the tray incorporating the dehumidifying function is selected by the above procedure.

The control procedure is shown in FIG. 19. Control section 103 awaits printing instruction (step M1), and if the printing instruction is entered (Yes in step M1), control section 103 judges whether the specific sheet type is instructed to be used (step M2). If no specific sheets type is instructed (No in step M2), control section 103 selects a tray of the highest priority, from among the trays accommodating the sheets other than the specific sheet type (step M5), and conducts the printing operation (step M6). If the specific sheet type is instructed to be used (Yes in step M2), control section 103 judges the ambient humidity outside the apparatus (step M3), and judges whether the judged humidity is equal to or lower than the predetermined value (step M4). If the humidity is equal to or lower than the predetermined value (Yes in step M4), control section 103 selects the tray of the highest priority (step M8), and conducts the printing operation (step M6). If the humidity is higher than the predetermined value (No in step M4), control section 103 judges the humidity inside the trays incorporating the dehumidifying function (step M9), and judges whether the trays exist whose humidity is equal to or lower than the predetermined value, among the trays incorporating the dehumidifying function (step M10). If it is yes in step M10, control section 103 selects the tray of the highest priority from among said trays, and conducts the printing operation (step M6). If it is not in step M10, control section 103 starts the dehumidifying operation (step M12), and the procedure returns to step M9, and control section 103 continues the above judgment operation until the dehumidification has been completed. When the printing operation is completed (Yes in step M13), control section 103 stops dehumidification (step M14). By the above procedures, when the trays incorporating the dehumidifying function are to be selected, the tray whose humidity is equal to or lower than the predetermined value can be selected from among the trays incorporating the dehumidifying function, which prevents the generation of the humidity problems in the high humidity environments.

Due to the above control, when the specific sheet type, which is to be used while considering the humidity, has been instructed to be used, said sheet type has the problem in the high humidity environments, so that printing is conducted on the specific type sheets in the humidity equal to or lower than the predetermined value. On the other hand, the normal sheet, which is other than the specific sheet type, has no problem in the high humidity environments, therefore, for the normal sheet, the tray is selected in accordance with the priority of the trays, which can prevent the generation of the humidity problems, and conduct effectively the printing operation.

Figure 20:
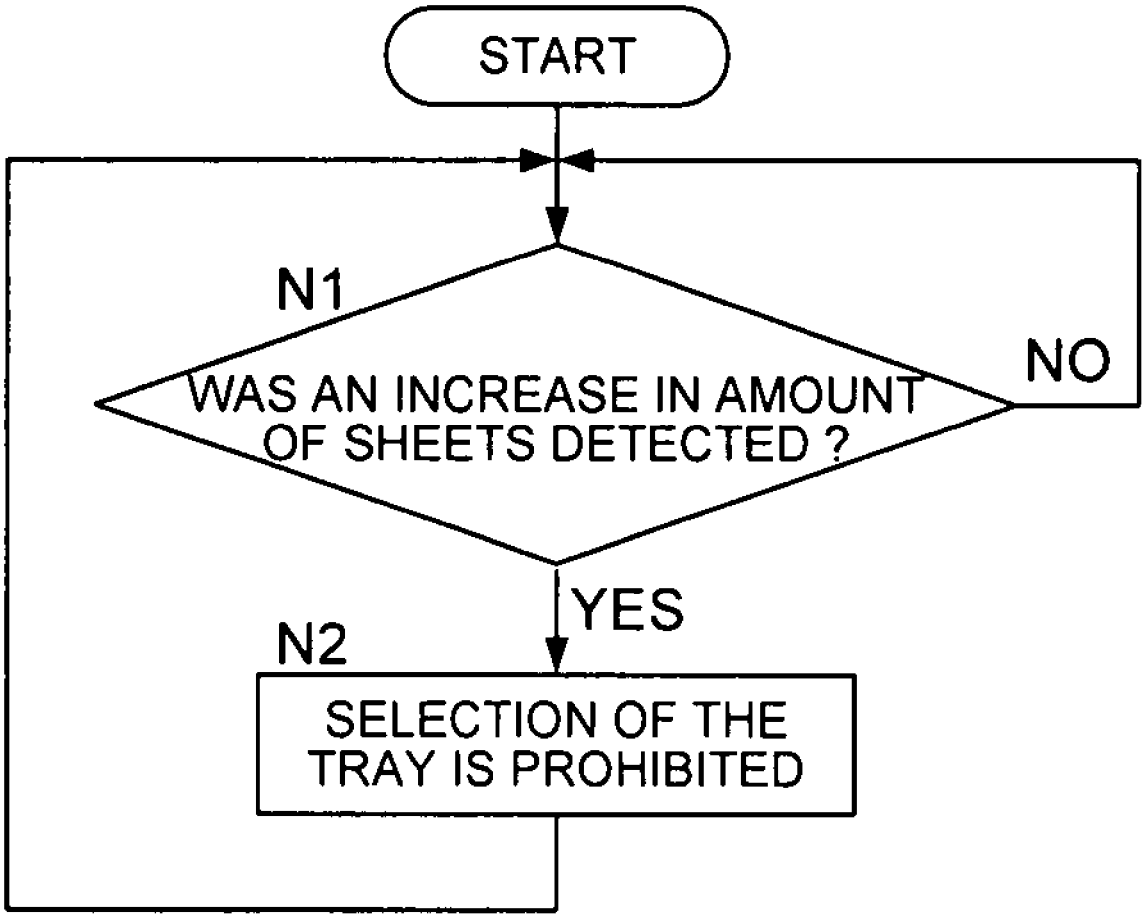
FIG. 20 is a flow chart of the present invention, wherein the amount of paper sheets is increased because more sheets are supplied to the tray.

Embodiment 13, see FIG. 20

In addition, in each control procedure of above embodiments 1-12, the control is conducted on the assumption that the humidity inside the tray is appropriately judged by the detection of the humidity or the temperature in the tray. However, when the amount of sheets increases due to the supply of the sheets into the tray, the humidity sensor in the tray cannot immediately detect the change of the humidity, so that the detected results become incorrect. Accordingly, when the amount of sheets is increased in the tray, said tray is eliminated from the selection during a predetermined time interval, which is preferable for the control. The predetermined time is fitly determined, and is memorized in control section 103. Further, the predetermined time can be determined based on the sheet type, the sheet size and the sheet weight classification.

FIG. 20 shows this procedure. Control section 103 continuously detects the amount of increase of the sheets in each tray (step N1), when control section 103 detects the increase of the sheets in a tray, control section 103 prohibits the selection of said tray (step N2).

The embodiments of the present invention have been explained. The above descriptions in the present embodiments show only an example of the image forming apparatus of the present invention, and descriptions are not limited to this embodiment. These detailed structures and operations of the present embodiment can be appropriately changed within the scope of this invention as long as it does not deviate from the contents of the present invention.

Based on the present invention, image formation is prohibited onto the high humidity sheets, so that the problems, such as the generation of sheet jam, the accumulation of sheet powder, and the reduction of the fixing temperature, are overcome under the high humidity environment.

Further, image formation is prohibited only for the specific sheets which require the dehumidification, and image formation is immediately conducted for the sheets other than the specific sheets, so that image formation can be conducted quickly and effectively without conducting unnecessary dehumidification.

Still further, under the high humidity environment, image formation can be started before the dehumidification is completed, while the dehumidification is conducted, so that the time for waiting the start of printing operation is reduced, which is preferable for image formation.

What is claimed is:

1. An image forming apparatus, comprising:

an image forming section which conducts image formation on a sheet based on an image data;

a tray which accommodates the sheets to be supplied to the image forming section;

a humidity detecting unit which detects humidity inside the tray;

a dehumidifying device which conducts dehumidification inside the tray; and a control section which controls the image forming section to prohibit image formation when the humidity inside the tray is higher than a predetermined value, the control section further controls the dehumidifying device to conduct the dehumidification inside the tray when the humidity inside the tray is equal to or lower than the predetermined value, and the control section still further controls the image forming section to conduct the image formation on the when the humidity inside the tray has been equal to or lower than the predetermined value.

2. The image forming apparatus of claim 1, further comprising a sensor which detects an amount of sheets, wherein when an increase of the sheet is detected by the sensor, the control section prohibits selection of the tray in which the amount of sheets increases.

3. An image forming apparatus, comprising:

an image forming section which conducts image formation on a sheet based on image data;

a tray which accommodates the sheets to be supplied to the image forming section;

a humidity detecting unit which detects humidity inside the tray;

a dehumidifying device which conducts dehumidification inside the tray; and a control section which controls the dehumidifying device and the image forming section;

wherein when a specific sheet type is instructed to be used for the image formation, and when the humidity inside the tray is higher than a predetermined value, the control section controls the image forming section to prohibit the image formation, and further controls the dehumidifying device to conduct the dehumidification inside the tray, and when the humidity inside the tray has been equal to or lower than the predetermined value, the control section controls the image forming section to conduct the image formation, and wherein when a sheet other than a specific type is instructed to be used for the image formation to the control section, the control section controls the image forming section to conduct image formation regardless of the humidity inside the tray.

4. An image forming apparatus, comprising:

an image forming section which conducts image formation on a sheet based on image data;

plural trays which accommodate the sheets to be supplied to the image forming section;

a humidity detecting unit which is mounted in each tray of the plural trays and detects humidity inside the tray;

a dehumidifying device which is mounted in each tray of the plural trays and conducts dehumidification inside the tray; and a control section which controls the dehumidifying device, the control section selects a tray inside which the humidity is equal to or lower than a predetermined value from among the plural trays, and the control section controls the image forming section to conduct the image formation on the sheet which is supplied from the selected tray.

5. The image forming apparatus of claim 4, wherein when a tray inside which the humidity is equal to or lower than the predetermined value does not exist, the control section controls the image forming section to prohibit the image formation, and controls the dehumidifying device in each tray to conduct the dehumidification, wherein when the humidity inside a tray becomes equal to or lower than the predetermined value, the control section controls the image forming section to conduct the image formation.

6. The image forming apparatus of claim 5, wherein when a specific type of sheets is instructed to be used for the image formation, the control section controls as above, and when the tray accommodating the sheets other than the specific type is selected, the control section controls the image forming section to conduct the image formation, regardless of the humidity inside the tray.

7. An image forming apparatus, comprising:

an image forming section which conducts image formation on a sheet based on image data;

plural trays which accommodate the sheets to be supplied to the image forming section;

a humidity detecting unit which is mounted in each tray of the plural trays and detects humidity inside the tray;

a dehumidifying device which is mounted in each tray of the plural trays and conducts dehumidification inside the tray;

an operation section which assigns a priority for selecting trays from among the plural trays; and a control section which controls the dehumidifying device, the control section selects a highest priority tray inside which the humidity is equal to or lower than a predetermined value from among the plural trays based on the humidity inside the plural trays based on detected results detected by the humidity detecting unit of each tray and based on the priority assigned to the trays, and the control section controls the image forming section to conduct the image formation.

8. The image forming apparatus of claim 7, wherein when the control section judges that the humidity inside the plural trays is equal to or lower than the predetermined value, the control section controls each dehumidifying device to conduct the dehumidification inside each tray.

9. An image forming apparatus, comprising:

an image forming section which conducts image formation on a sheet based on image data;

plural trays which accommodate the sheets to be supplied to the image forming section;

a humidity detecting unit which is mounted in each tray of the plural trays and detects humidity inside the tray;

a dehumidifying device which is mounted in each tray of the plural trays and conducts dehumidification inside the tray; and a control section which controls the dehumidifying device and the image forming section, wherein when no tray exists among the plural trays inside which the humidity is equal to or lower than a predetermined value, the control section controls the dehumidifying device of each tray to start the dehumidification, and wherein the control section selects a tray inside which the humidity is lowest among the plural trays, and controls the image forming device to conduct image formation.

10. The image forming apparatus of claim 9, further comprising an operation section which assigns a priority order for selecting a tray to the plural trays, wherein when a tray exists among the plural trays inside which the humidity is equal to or lower than the predetermined value, the control section selects a highest priority tray among the plural trays inside which the humidity is equal to or lower than the predetermined value, and controls the image forming section to conduct the image formation.

11. An image forming apparatus, comprising:

an image forming section which conducts image formation on a sheet based on image data;

plural trays which accommodate the sheets to be supplied to the image forming section;

a humidity detecting unit which is mounted in each tray of the plural trays and detects humidity inside the tray;

a dehumidifying device which is mounted in each tray and conducts dehumidification inside the tray; and a control section which controls the dehumidifying device, when no tray exists inside which the humidity is equal to or lower than the predetermined value among each tray whose humidity has been judged based on a detected result detected by the humidity detecting unit, the control section selects a tray whose estimated time duration to completion of dehumidification is shortest from among the plural trays, and controls the image forming section to conduct image formation.

12. The image forming apparatus of claim 11, wherein when a tray exists inside which the humidity is equal to or lower than the predetermined value, the control section selects the tray inside which the humidity is equal to or lower than the predetermined value, and controls the image forming section to conduct the image formation.

13. An image forming apparatus, comprising:

an image forming section which conducts image formation on a sheet based on image data;

plural trays which accommodate the sheets to be supplied to the image forming section;

a humidity detecting unit which is mounted in each tray of the plural trays and detects humidity inside the tray;

a dehumidifying device which conducts dehumidification inside the tray;

an operation section which assigns a priority to the plural trays; and a control section which controls the dehumidifying device, wherein the control section judges whether an estimated time duration until the dehumidification is completed by the dehumidifying device, is longer than a predetermined time, from among the trays one by one from a highest priority tray, when the estimated time duration is shorter than the predetermined time, the control section selects a tray, when the estimated time duration is equal to or longer than the predetermined time, the control section judges a next priority tray, when the estimated time duration of the next priority tray is shorter than the predetermined time, the control section selects the next priority tray for the image formation, when the estimated time duration of the next priority tray is equal to or longer than the predetermined time, and when a third priority tray exists, the control section judges whether the estimated time duration of the third priority tray is equal to or longer than the predetermined time, and when the estimated time duration is equal to or longer than the predetermined time, the control section repeats the same control as above, and when the estimated time durations for all trays are equal to or longer than the predetermined time, the control section selects a highest priority tray based on the priority, and controls the image forming section to conduct image formation.

14. An image forming apparatus, comprising:

an image forming section which conducts image formation on a sheet based on image data;

plural trays which accommodate the sheets to be supplied to the image forming section, including a tray having a dehumidifying function to maintain humidity inside the tray to be equal to or lower than a predetermined value, and a tray having no dehumidifying function; and a control section which selects the tray having the dehumidifying function among the plural trays, and controls the image forming section to conduct the image formation.

15. The image forming apparatus of claim 14, further comprising:

a humidity detecting unit which detects the humidity inside the tray having the dehumidifying function; and a dehumidifying device which conducts dehumidification inside the tray having the dehumidifying function.

16. The image forming apparatus of claim 14, further comprising;

an operation section which assigns a priority to the plural trays for selecting a tray to be used for the image formation; and an external humidity sensor which detects humidity outside the image forming apparatus, wherein when the humidity detected by the external humidity sensor is higher than a predetermined value, the control section selects the tray having the dehumidifying function based on the priority assigned by the operation section, and when the humidity detected by the external humidity sensor is equal to or lower than the predetermined value, the control section selects a tray based on the priority.

17. The image forming apparatus of claim 14, wherein when plural trays having the dehumidifying function exist, the control section selects a tray inside which the humidity detected by the humidity detecting unit is equal to or lower than the predetermined value.

18. The image forming apparatus of claim 14, further comprising an operation section which assigns a priority to the plural trays for selecting a tray to be used for the image formation, wherein when a sheet other than a specific type is instructed to be used for the image formation, the control section selects a tray from among the trays which accommodate the sheet other than the specific sheet type based on the priority.

* * * * *